US011543135B2

(12) United States Patent
White et al.

(10) Patent No.: US 11,543,135 B2
(45) Date of Patent: Jan. 3, 2023

(54) HINGE ASSEMBLY WITH SLOW CLOSE AND/OR SLOW OPEN CHARACTERISTICS

(71) Applicant: Mansfield Engineered Components, Inc., Mansfield, OH (US)

(72) Inventors: Brian S. White, Galion, OH (US); James J. Collene, Bucyrus, OH (US)

(73) Assignee: Mansfield Engineered Components, Inc., Mansfield, OH (US)

( * ) Notice: Subject to any disclaimer, the term of this patent is extended or adjusted under 35 U.S.C. 154(b) by 46 days.

(21) Appl. No.: 17/145,918

(22) Filed: Jan. 11, 2021

(65) Prior Publication Data

US 2021/0131672 A1 May 6, 2021

Related U.S. Application Data

(63) Continuation of application No. 16/529,688, filed on Aug. 1, 2019, now Pat. No. 10,890,334, which is a (Continued)

(51) Int. Cl.
*F24C 15/02* (2006.01)
*E05F 1/12* (2006.01)
(Continued)

(52) U.S. Cl.
CPC ..... *F24C 15/023* (2013.01); *E05D 3/12* (2013.01); *E05D 7/00* (2013.01); *E05F 1/1261* (2013.01);
(Continued)

(58) Field of Classification Search
CPC . F24C 15/023; E05D 3/12; E05D 7/00; E05F 3/20; E05F 1/1261; E05F 1/1041;
(Continued)

(56) References Cited

U.S. PATENT DOCUMENTS 1,228,042 A 5/1917 O'Dowd
1,253,376 A 1/1918 Hick
(Continued)

FOREIGN PATENT DOCUMENTS

CN 207686490 U * 8/2018
CN 207944837 U * 10/2018
(Continued)

*Primary Examiner* — William L Miller
(74) *Attorney, Agent, or Firm* — Fay Sharpe LLP

(57) ABSTRACT

A hinge assembly for an associated appliance door includes an arm and a lever pivotally connected to the arm. The lever and arm are adapted to pivot relative to each other about a main pivot axis between a first position that corresponds to a closed position of the associated appliance door and a second position that corresponds to an opened position of the associated appliance door. A slide link is located adjacent the lever. A damper engagement structure is connected to the slide link. A biasing system urges the arm and lever toward the first position. A damper system includes a damper that damps pivoting movement between the arm and the lever for at least part of the movement between the arm and the lever when the arm and lever pivot relative to each other from the first position toward the second position.

13 Claims, 25 Drawing Sheets

Related U.S. Application Data continuation-in-part of application No. 16/140,360, filed on Sep. 24, 2018, now Pat. No. 10,451,291, which is a continuation of application No. 15/498,466, filed on Apr. 26, 2017, now Pat. No. 10,082,298.

(60) Provisional application No. 62/453,792, filed on Feb. 2, 2017, provisional application No. 62/714,076, filed on Aug. 2, 2018.

(51) Int. Cl.

| | |
|---|---|
| ***E05D 3/12*** | (2006.01) |
| ***E05D 7/00*** | (2006.01) |
| ***E05F 3/20*** | (2006.01) |
| ***E05F 5/02*** | (2006.01) |

(52) U.S. Cl.

CPC ..... *E05F 3/20* (2013.01); *E05F 5/02* (2013.01); *E05Y 2201/256* (2013.01); *E05Y 2201/264* (2013.01); *E05Y 2201/412* (2013.01); *E05Y 2201/638* (2013.01); *E05Y 2900/308* (2013.01); *Y10T 16/5383* (2015.01)

(58) Field of Classification Search

CPC ..... E05F 5/02; E05F 5/08; E05F 5/10; E05Y 2900/308; E05Y 2201/1256; E05Y 2201/264; E05Y 2201/412; E05Y 2201/638; Y10T 16/5383; Y10T 16/53834; Y10T 16/2771; Y10T 16/304; Y10T 16/61; Y10T 16/625; Y10T 16/585; Y10T 16/593

USPC ..... 16/286, 289, 54, 50, 82, 85, 72, 80; 312/319.2; 126/194

See application file for complete search history.

(56) References Cited

U.S. PATENT DOCUMENTS

| | | | | |
|---|---|---|---|---|
| 3,712,287 | A | 1/1973 | Summers, Jr. | |
| 5,269,043 | A | 12/1993 | Yang | |
| 6,397,836 | B1 | 6/2002 | Pelletier et al. | |
| 6,789,293 | B2 | 9/2004 | Habegger et al. | |
| 6,845,545 | B2 | 1/2005 | Han et al. | |
| 7,610,656 | B2 | 11/2009 | Vanini | |
| 7,676,888 | B2 | 3/2010 | Vanini | |
| 8,533,914 | B2 | 9/2013 | Vanini | |
| 8,544,971 | B2 | 10/2013 | Stocker | |
| 8,683,653 | B2 | 4/2014 | Bettinzoli | |
| 8,806,718 | B2 | 8/2014 | Elkasevic | |
| 8,806,719 | B2 | 8/2014 | Kleeman et al. | |
| 8,833,877 | B2 | 9/2014 | Elkasevic et al. | |
| 8,925,542 | B2 | 1/2015 | White et al. | |
| 9,074,400 | B2 | 7/2015 | Mirshekari et al. | |
| 9,121,211 | B1 | 9/2015 | White et al. | |
| 9,181,741 | B2 | 11/2015 | Bettinzoli | |
| 9,995,075 | B2 * | 6/2018 | Vanini | E05F 5/00 |
| 10,704,307 | B1 * | 7/2020 | Collene | E05D 5/02 |
| 11,187,021 | B2 * | 11/2021 | Gherardi | E05F 1/1261 |
| 2006/0032019 | A1 | 2/2006 | Kistner et al. | |
| 2007/0283532 | A1 | 12/2007 | Vanini | |
| 2008/0201907 | A1 | 8/2008 | Vanini | |
| 2008/0289144 | A1 | 11/2008 | Vanini | |
| 2010/0148646 | A1 | 6/2010 | Bettinzoli | |
| 2010/0281650 | A1 | 11/2010 | Kleemann et al. | |
| 2011/0017191 | A1 * | 1/2011 | White | E05D 3/02 312/319.2 |
| 2011/0068671 | A1 | 3/2011 | Vanini | |
| 2011/0113816 | A1 | 5/2011 | Stocker | |
| 2011/0146654 | A1 | 6/2011 | Basavalingappa Mudbasal et al. | |
| 2011/0146655 | A1 | 6/2011 | Basavalingappa Mudbasal et al. | |
| 2011/0148262 | A1 | 6/2011 | Basavalingappa Mudbasal et al. | |
| 2012/0067333 | A1 | 3/2012 | Mirshekari et al. | |
| 2013/0291853 | A1 | 11/2013 | Braden et al. | |
| 2013/0300273 | A1 | 11/2013 | Elkasevic et al. | |
| 2013/0307392 | A1 | 11/2013 | Elkasevic et al. | |
| 2013/0312217 | A1 | 11/2013 | Kleeman et al. | |
| 2013/0312220 | A1 | 11/2013 | Elkasevic | |
| 2013/0312221 | A1 | 11/2013 | Elkasevic | |
| 2014/0208542 | A1 * | 7/2014 | White | E05D 7/12 16/261 |
| 2014/0345082 | A1 * | 11/2014 | Collene | E05F 3/20 16/303 |
| 2017/0059176 | A1 | 3/2017 | SirLouis | |
| 2019/0316380 | A1 | 10/2019 | Kim et al. | |
| 2019/0316781 | A1 | 10/2019 | Kim et al. | |
| 2020/0263467 | A1 * | 8/2020 | White | E05D 7/0415 |

FOREIGN PATENT DOCUMENTS

| | | | | | |
|---|---|---|---|---|---|
| CN | 110259308 | A | * | 9/2019 | |
| CN | 210685670 | U | * | 6/2020 | |
| CN | 213683638 | U | * | 7/2021 | |
| DE | 29 39 727 | A1 | | 4/1981 | |
| DE | 10 2005 045 365 | A1 | | 3/2007 | |
| DE | 10 2007 029 696 | A1 | | 1/2009 | |
| EP | 1 884 181 | A1 | | 2/2008 | |
| EP | 1995524 | A2 | * | 11/2008 | E05F 1/1261 |
| EP | 2 284 344 | A2 | | 2/2011 | |
| EP | 2 664 737 | A2 | | 11/2013 | |
| EP | 2 977 537 | A1 | | 1/2016 | |
| EP | 3293332 | A1 | * | 3/2018 | E05D 3/18 |
| EP | 3 546 688 | A1 | | 10/2019 | |
| EP | 3748235 | A1 | * | 12/2020 | |
| TR | 201604159 | U | * | 7/2016 | |
| WO | WO 2009/030618 | A1 | | 3/2009 | |
| WO | WO-2013133774 | A1 | * | 9/2013 | E05F 1/1261 |
| WO | WO 2015/086470 | A1 | | 6/2015 | |
| WO | WO-2021010904 | A1 | * | 1/2021 | E05F 1/1261 |

* cited by examiner

HINGE ASSEMBLY WITH SLOW CLOSE AND/OR SLOW OPEN CHARACTERISTICS

CROSS-REFERENCE TO RELATED APPLICATIONS

This application is a continuation of U.S. application Ser. No. 16/529,688 filed Aug. 1, 2019, now assigned U.S. Pat. No. 10,890,334, which is a continuation-in-part of U.S. application Ser. No. 16/140,360 filed Sep. 24, 2018, now U.S. Pat. No. 10,451,291, which is a continuation of U.S. application Ser. No. 15/498,466 filed Apr. 26, 2017, now U.S. Pat. No. 10,082,298, which claims priority from and benefit of the filing date of U.S. provisional application Ser. No. 62/453,792 filed Feb. 2, 2017. This application also claims priority from and benefit of the filing date of U.S. provisional application Ser. No. 62/714,076 filed Aug. 2, 2018. The entire disclosure of each of said prior applications is hereby incorporated by reference into the present specification.

BACKGROUND

It is generally known to provide appliance hinge assemblies with dampers or snubbers to provide slow open and/or slow close damping characteristics for the associated appliance door. Known hinge assemblies have been found to provide the required damping characteristics and have performed very well. The desired slow open and slow closed characteristics must be provided while meeting the cost, space, serviceability, and durability requirements for the hinge assembly. As such, a need has been identified for an improved hinge assembly that provides the required slow close and/or slow open characteristics while meeting or exceeding the required cost, space, durability, and other requirements associated with ovens and other appliances.

SUMMARY

In accordance with one embodiment of the present development, a hinge assembly for an associated appliance door includes an arm and a lever. The lever includes an inner end pivotally connected to the arm and an outer end spaced from the inner end, the lever and arm adapted to pivot relative to each other about a main pivot axis between a first position that corresponds to a closed position of the associated appliance door and a second position that corresponds to an opened position of the associated appliance door. The lever and arm pivot relative to each other through an intermediate position located between the first and second positions when the lever and arm pivot between the first and second positions. A slide link is located adjacent the lever and includes a slide link inner end and a slide link outer end spaced from the slide link inner end. The slide link inner end is pivotally connected to the arm at a location that is offset from the main pivot axis such that relative pivoting movement between the lever and the arm about the main pivot axis results in movement of the slide link relative to the lever. A damper engagement structure is connected to the slide link. A biasing system urges the arm and lever toward the first position. A damper system damps pivoting movement between the arm and the lever for at least part of the pivoting movement between the arm and the lever when the arm and lever pivot relative to each other from the first position toward the second position. The damper system comprising a damper that is engaged by the damper engagement structure during at least part of the relative movement between the arm and the lever when the arm and lever pivot relative to each other from the first position toward the second position.

BRIEF DESCRIPTION OF THE DRAWINGS

(FIG. 3C is a partial view);

DETAILED DESCRIPTION

Figure 1:
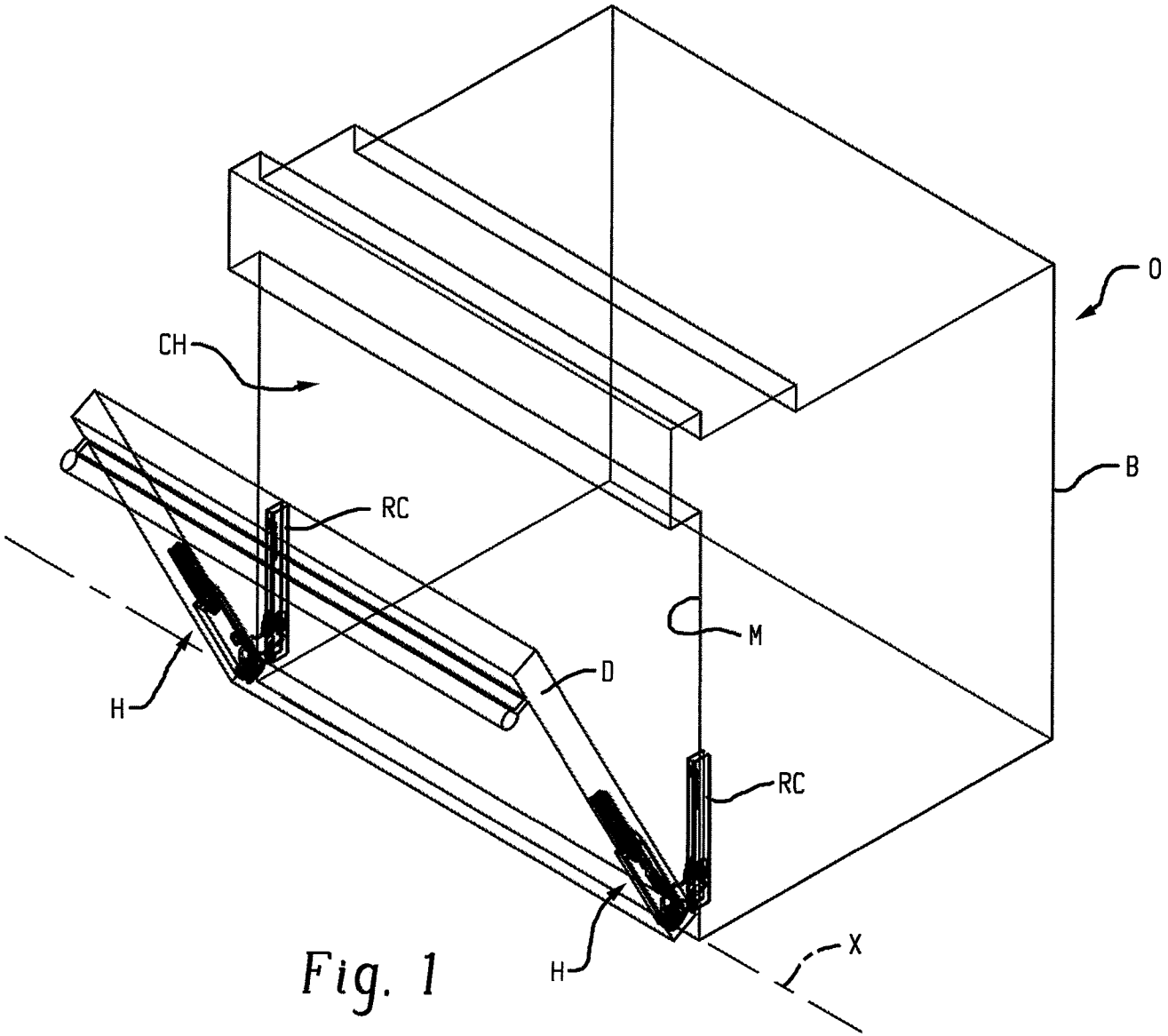
FIG. 1 shows an oven or other appliance including a body in which a processing (cooking) chamber is defined, and comprising a door for selectively closing an open mouth of the chamber that is operatively connected to the body by at least one hinge assembly according to the present development.

FIG. 1 shows an oven O including a body B in which a cooking chamber CH is defined, and comprising a door D for selectively closing an open mouth M of the cooking chamber. The door D is pivotally connected to the body B and pivots about a pivot axis X (typically the pivot axis X is horizontally oriented) between a closed position in which the door closes the mouth M of the cooking chamber and an opened position in which the door D is moved away from the mouth M of the cooking chamber CH to provide access to the cooking chamber CH. FIG. 1 shows a partially opened or intermediate position for the door D, and the door D typically moves from its closed position to a fully opened position where it is oriented approximately 85-90 degrees relative to the body B. The door D is pivotally connected to the body B by first and second hinges or hinge assemblies H located adjacent opposite lateral sides of the mouth M and oven body B. At least one of the hinge assemblies H is provided in accordance with the present development as described herein. Alternatively, the door D and hinge assemblies H are arranged such that the door pivots relative to the body B about a vertical axis or other axis oriented 90 degrees from or otherwise transverse relative the illustrated horizontal pivot axis X to provide a side-swing door D. The oven O can alternatively be structured and provided as any other appliance such as a clothes washer or dryer, or other appliance, in which case the cooking chamber CH is more generally referred to as a chamber or processing chamber.

Figure 2B:
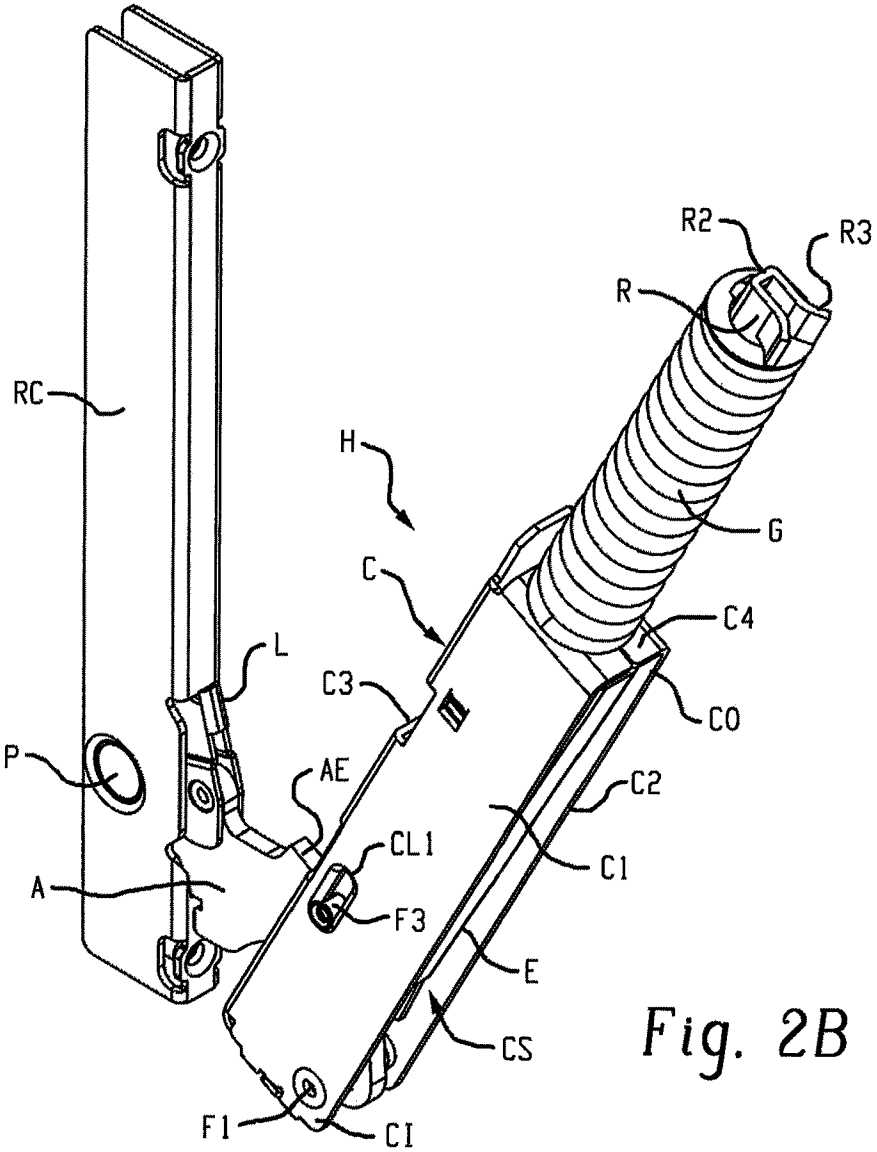
FIGS. 2A & 2B provide respective right and left side isometric views of a first embodiment of a hinge assembly provided in accordance with the present development, and show the hinge assembly operably mated with an associated receiver that is provided as part of and/or connected to the appliance body B.
Figure 2A:
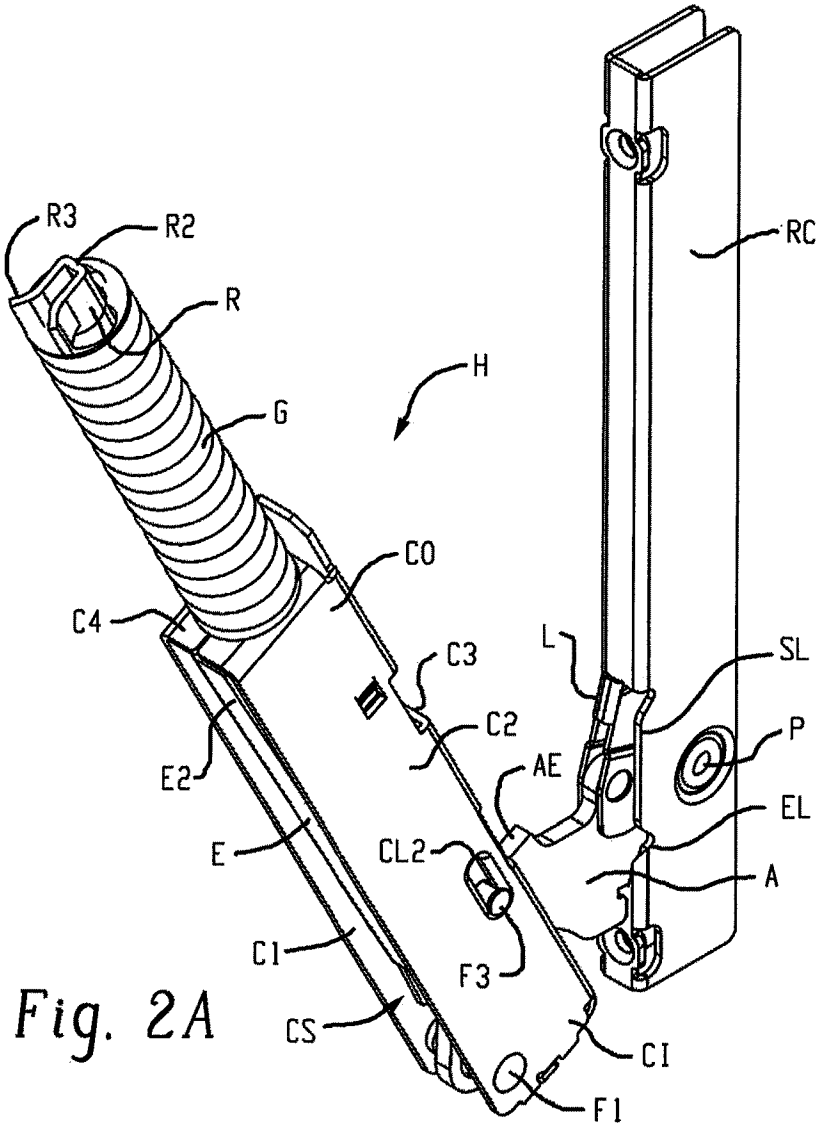
Figure 3A:
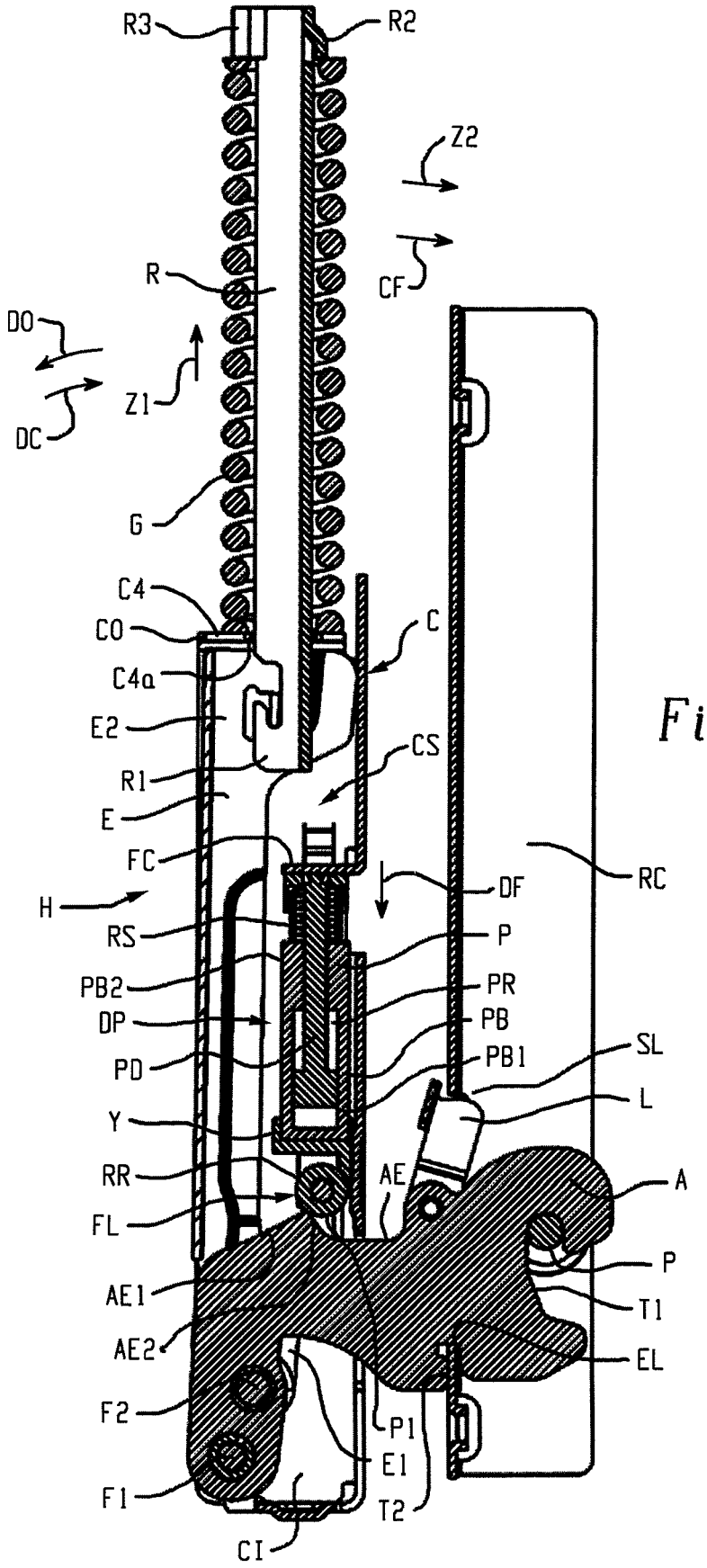
FIGS. 3A, 3B, and 3C are section views that respectively show the hinge assembly H in first, intermediate, and second operative positions
Figure 3B:
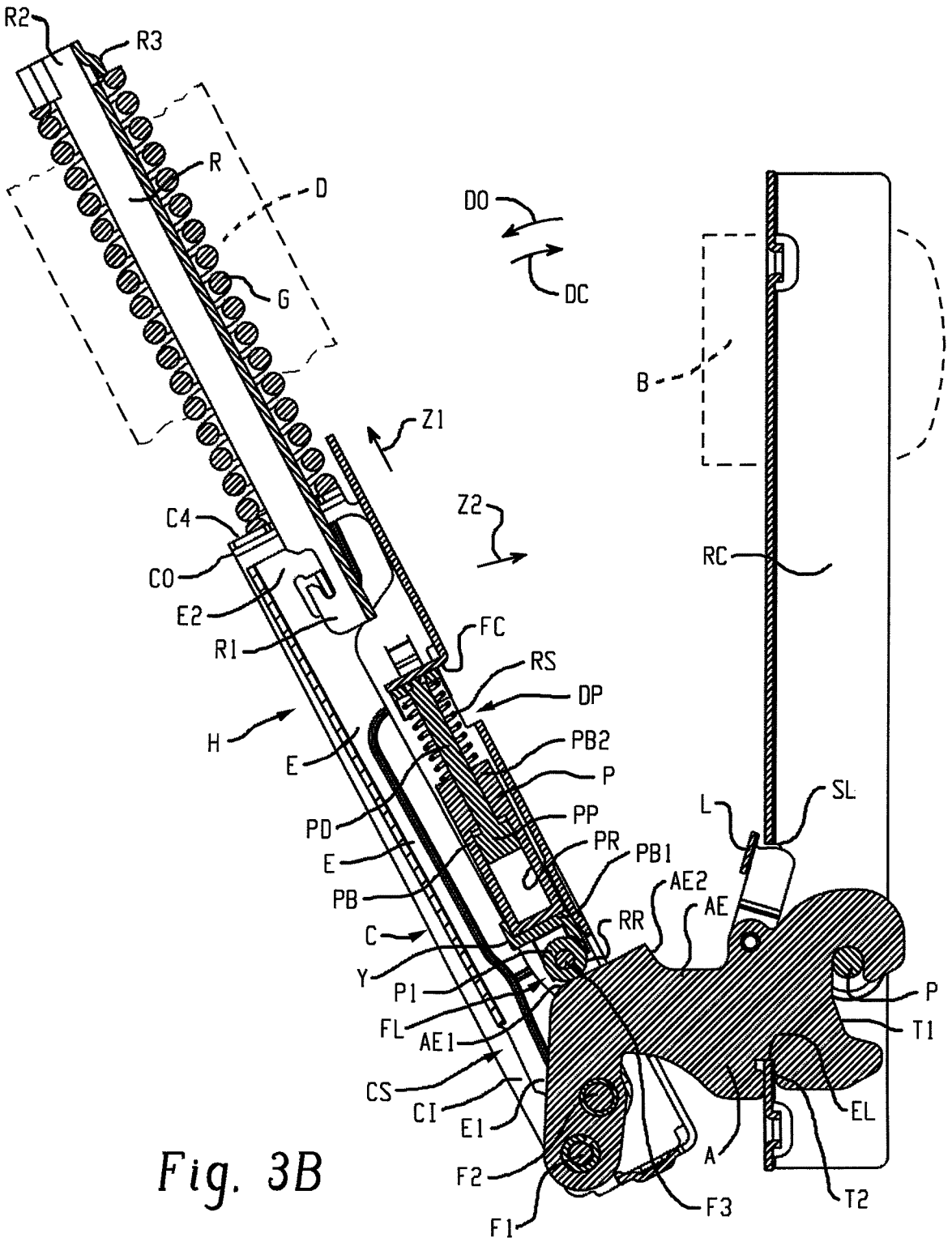
Figure 3C:
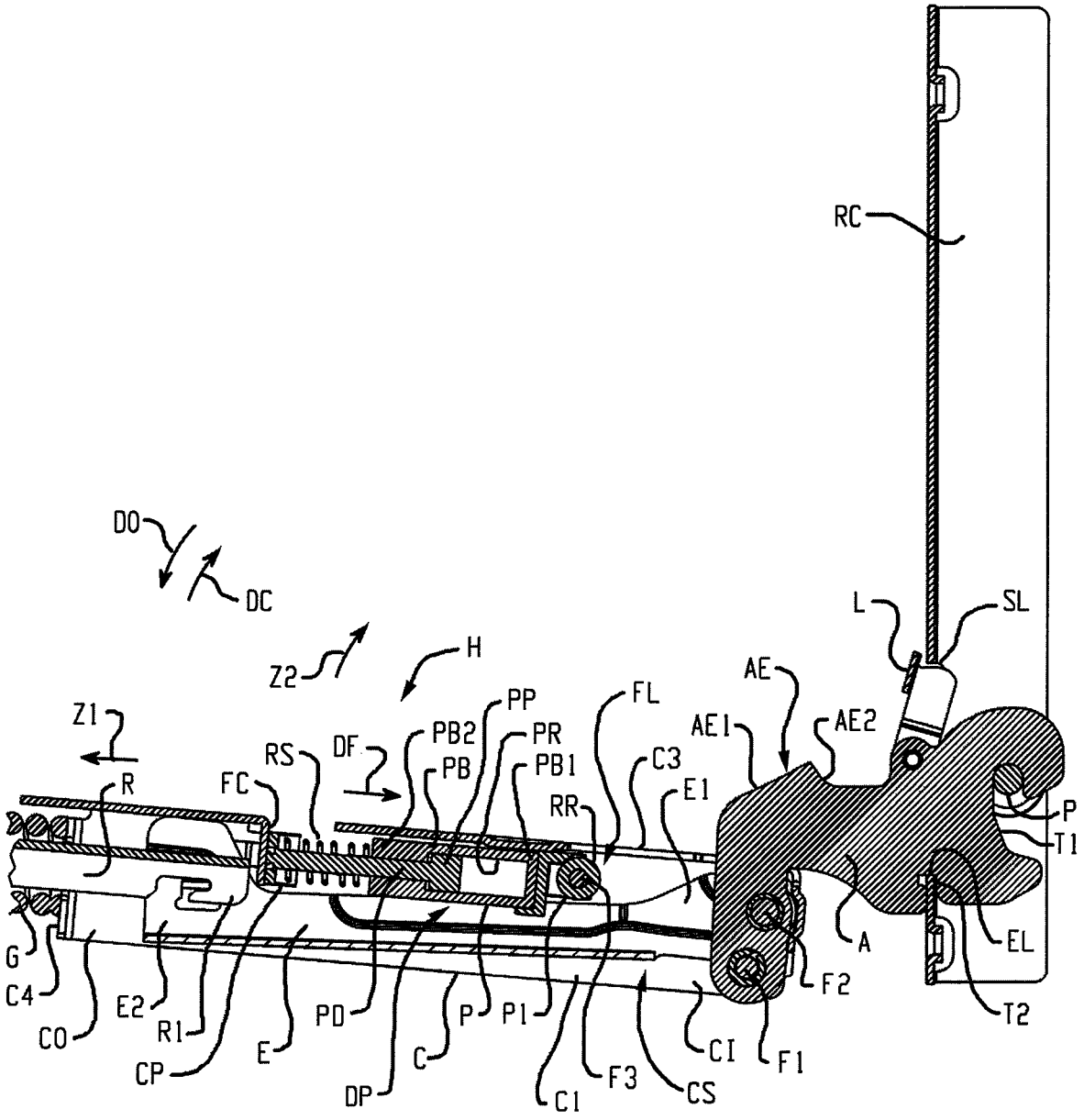

FIGS. 2A & 2B provide respective right and left side isometric views of a first embodiment of a hinge assembly H provided in accordance with the present development, and show the hinge assembly H operably mated with an associated appliance receiver RC that is provided as part of and/or connected to the oven body B. The hinge assembly H is shown in an intermediate position corresponding to the partially opened position of an oven door D as shown in FIG. 1. FIGS. 3A-3C are section views that show the hinge assembly H in first, intermediate, and second operative positions (FIG. 3C provides a partial view).

Referring to all of FIGS. 2A-3C, the receiver RC is conventional and can take a wide variety of forms. The receiver RC comprises a channel or other member including a receiver slot SL adapted to receive a "claw" or door mounting arm A of the hinge assembly H. The receiver RC is secured to the oven body B adjacent one of the lateral sides of the opening or mouth M of the cooking chamber CH. The arm A of the hinge assembly H includes one or more slots or other mounting locations T1,T2 adapted to engage the receiver RC for operatively securing the arm A to the receiver RC. The illustrated receiver RC includes a pin P that is engaged by a first slot T1 of the arm A, and includes a lip or edge EL partially defining a lower edge of the receiver slot SL that is engaged by the second slot T2 of the arm A. Alternatively, the receiver RC can include two or more spaced-part pins P to be respectively engaged by the slots T1,T2, etc., and/or other parts of the arm A, or the receiver RC can include no pins P but instead include other structures to be engaged by the slots T1,T2 or other parts of the arm A. It is not intended that the present invention be limited to the illustrated arm A or receiver RC.

The hinge assembly H comprises a latch L that is pivotally or otherwise movably connected to the arm A, and the latch is shown in its engaged position where it is located to block and prevent or minimize movement of the arm A relative to the receiver RC as is required to disconnect the arm A from the receiver such that when the latch L is engaged, the arm A is captured to and unable to be disconnected from the receiver RC. The latch L is selectively manually pivotable to its disengaged position where it is located away from the receiver RC and slot SL so that the arm A can be separated from the receiver RC. Alternatively, a pin, fastener, and/or other structure is used to secure the arm A to the receiver RC.

The hinge assembly H further comprises a door mounting channel or door mounting lever C pivotally connected to the arm A by a rivet or other main pivot fastener F1 such that the lever C pivots about main pivot fastener F1 and about the main pivot axis X between a first position (FIG. 3A) corresponding to a closed position of the oven door D, and a second position (FIG. 3C) corresponding to a fully opened position of the oven door D. Between its first and second positions, the door mounting lever C pivots through an intermediate position (FIG. 3B) corresponding to a partially opened intermediate position of the oven door D. The oven door D is connected to the lever C (FIG. 3B) for movement therewith about the pivot axis X. In the illustrated embodiment, the lever C comprises a generally U-shaped channel provided by a metal stamping or other structure and comprises first and second spaced-apart parallel side walls C1,C2 that are joined by a transverse end wall C3 such that a space CS is defined between the side walls C1,C2 and the end wall C3. The lever C includes an inner end CI that is pivotally connected to the arm A by the main pivot fastener F1 and includes an outer end CO that is spaced outwardly from the inner end CI.

A slide body or slide link E is located adjacent the lever C and includes a first or inner end E1 (sometimes referred to as a "slide link inner end E1") that is pivotally connected to the arm A by a rivet or other slide link pivot fastener F2 at a connection location that is offset or eccentrically spaced from the main pivot axis X and main pivot fastener F1. The slide link E further includes a second or outer end E2 (sometimes referred to as a "slide link outer end E2") spaced outwardly relative to the slide link inner end E1. In the illustrated embodiment, the slide link E is located in or nested in the space CS of the lever C. The slide link pivot fastener F2 is located above or spaced outwardly from the main pivot fastener F1 when the lever C is located in its first (door-closed) position as shown in FIG. 3A such that the slide link pivot fastener F2 is located closer to the outer end CO of the lever C as compared to the main pivot fastener F1 when the lever C is located in its first (door-closed) position. The slide link pivot fastener F2 is located vertically above the main pivot fastener F1 when the hinge H is operatively connected to the receiver RC. The offset arrangement of the slide link pivot fastener F2 from the main pivot fastener F1 causes, induces, or results in relative sliding movement of the slide link E relative to the lever C when the lever C and slide body E are pivoted simultaneously about their respective pivot fasteners F1, F2 as can be seen in comparing FIGS. 3A,3B, and 3C. The slide link E is shown as a single one-piece metallic structure, but it can alternatively be constructed from a polymeric and/or other material and can alternatively be comprised of two or more interconnected links or members.

The hinge assembly H further comprises a biasing system for continuously urging the lever C toward its first (door-closed) position. The biasing system comprises a spring G that is operably engaged between the lever C and the slide link E through a spring rod R. The spring G exerts an outwardly directed biasing force Z1 (FIGS. 3B & 3C) on the spring rod R and slide link E relative to the lever C that urges or biases the slide link E toward the outer end CO of the lever C. Due to the offset arrangement of the pivot fasteners F1, F2 as described, the biasing force Z1 induces an angular door closing force or torque Z2 in the lever C that urges or biases the lever C toward the first (door-closed) position. In the illustrated embodiment, the spring G comprises a helical coil spring arranged as a compression spring such that the outward biasing force Z1 results from resilient lengthening of the spring G.

As noted, the biasing system of the hinge assembly comprises a spring rod R. A first or inner end R1 of the spring rod R (spring rod inner end R1) is connected to or otherwise operably engaged with the outer end E2 of the slide link E. The spring rod R also includes an opposite, second or outer end R2 (spring rod outer end R2) spaced outwardly from its inner end R1. As shown herein, the inner end R1 of the spring rod includes a hook or similar structure that directly engages the outer end E2 of the slide link, but a rivet or other fastener, linkage, and/or any other suitable direct or indirect connect can be used. The lever C includes an outer transverse end wall C4 that includes an aperture C4*a* through which the spring rod R extends such that the inner end R1 of the spring rod R is located in the space CS of the lever C or otherwise adjacent the lever C, and the opposite outer end R2 of the spring rod R2 is spaced outwardly from the end wall C4. The coil spring G is coaxially positioned about the spring rod R such that the spring rod extends through the open center of the spring G. The outer end R2 of the spring rod includes a stop R3 which comprises an enlarged portion of the second end R2 of the spring rod R or a separate structure or member connected to the outer end R2 of the spring rod R, and the spring G is captured on the spring rod between the stop R3 and the transverse end wall C4.

Comparing FIGS. 3A-3C, it can be seen that pivoting movement of the lever C in a door-opening direction DO from its first position (FIG. 3A) toward its second position (FIG. 3C) against the biasing force Z1 and closing force Z2 of the spring G causes the slide link E to move inwardly away from the transverse end wall C4 and pull the spring rod R inwardly relative to the transverse end wall C4, which causes the spring G to be resiliently compressed. When the lever C is moved in the opposite door-closing DC direction from its second position (FIG. 3C) toward the first position (FIG. 3A), the spring G resiliently elongates and pulls or biases or urges the spring rod R and slide link E outwardly away from the main pivot fastener F1 and main pivot axis X via biasing force Z1 to urge the lever C and oven door D toward the first (closed) position to assist with the oven door closing.

To counteract the closing force Z2 and prevent undesirably fast closing and slamming of the oven door D, the hinge assembly H further comprises a damper system DP that damps and slows movement of the lever C in the door closing direction DC for at least part of the closing movement or arc of the lever C from its second (door-opened) position to it first (door-closed position). The damper system DP is connected to the mounting lever C and comprises a damper P connected to the mounting lever C such that the damper P pivots with the mounting lever C about the main pivot axis X. The damper P includes an inner end P1 that contacts the arm A of the hinge assembly H during at least part of the angular closing movement or arc of the lever C when the lever C moves in the door closing direction DC from its second position toward its first position. Contact between the inner end P1 of the damper P and the arm A activates the damper P such that the damper P exerts a damping force DF between the lever C and the arm A that counteracts the spring biasing force Z1 and closing force Z2 to slow and damp movement of the lever C in the door closing direction DC. The arm A of the hinge assembly includes an upper or outer cam edge AE that comprises a primary cam portion AE1 and an outwardly projecting lobed portion AE2.

In the illustrated embodiment, the damper system DP comprises a fluid damper cylinder P including a damper body PB that includes a cylindrical damper bore PR in which a piston PP is slidably supported for reciprocal sliding movement between an extended position (FIG. 3C) and a retracted position (FIG. 3A). The extended and retracted positions of the piston PP correspond respectively to extended and retracted positions or states of the damper P. The damper body PB includes an inner end PB1 oriented toward the inner end CI of the lever C and includes an opposite outer end PB2. A piston rod PD includes an inner end connected to the piston PP and extends outwardly from the bore PR at the outer end PB2 of the damper body PB. An outer end of the piston rod PD is abutted with and optionally also connected to a flange FC or other structure of the lever C in a manner that prevents relative movement between the piston rod PD and lever C. A gas or liquid damping fluid and/or a mechanical damping spring is contained in the bore PR and acts on the piston PP to damp its movement from the extended position toward the retracted position. Preferably, the piston PP is configured such that the damping fluid damps movement of the piston PP to a greater extent when the piston is moving from its extended position toward its retracted position as compared to the opposite direction of movement of the piston to facilitate a faster return or reset of the piston from its retracted position to its extended position. The illustrated damper P does not include a mechanical piston return spring within the bore PR, so a return spring RS is coaxially positioned about the piston rod PD and engaged between the damper body PB and the lever C or piston rod PD and exerts a return force on the damper body PB that urges the damper body PB toward the inner end CI of the lever C which returns the piston PP to its extended position. As shown herein, the return spring RS is captured coaxially on the piston rod PD between the second end PB2 of the damper body PB and a plastic or metal cap CP or other structure that is connected to or formed as part of the outer end of the piston rod PD. Alternatively, the return spring RS can be located in the damper bore PR between the piston PP and the inner end PB1 of the damper body PB.

In the embodiment of FIGS. 3A-3C, the inner end PB1 of the damper body PB includes a yoke or other support structure Y, and a roller, bushing, slide member, or like follower FL connected to the yoke and/or formed as a part of the yoke Y. The yoke Y can be molded or otherwise provided as part of the damper body PB, e.g., molded as a one-piece polymeric construction with the damper body PB, or the yoke Y can be a separate piece that is connected to the damper body PB. As shown, the follower FL comprises a rotatable roller RR such as a polymeric or metal roller, but the follower FL alternatively comprises a non-rotatable polymeric, metal, or other structure connected thereto or formed as a part thereof. The roller RR is operatively captured on the yoke by a follower fastener F3 (see FIGS. 2A, 2B, 3B) such as a pin or rivet. Preferably, as shown herein, the opposite first and second side walls C1,C2 of the door mounting lever C include respective first and second elongated slots CL1,CL2 that are aligned or registered with each other and that extend linearly along respective axes that lie parallel to the central axis of the damper bore PR. Opposite first and second ends of the follower fastener F3 located on opposite sides of the roller RR are located respectively in the first and second elongated slots CL1,CL2 so as to connect the roller RR to the door mounting lever C in a manner that stabilizes the roller RR and damper body PB while allowing reciprocal sliding movement of the roller RR along an axis that is parallel to the central axis of the damper bore PR. Engagement of the follower fastener F3 in the slots CL1,CL2 limits the magnitude of the reciprocal sliding movement of the roller RR.

The follower FL is separated and disengaged from the cam edge AE when the lever C is located in its second (door-opened) position as shown in FIG. 3C. As shown in FIG. 3B, movement of the lever C in the door closing direction DC to the intermediate position causes the follower FL to contact the cam edge AE. The first portion AE1 of the cam edge AE is flat or otherwise shaped such that further movement of the lever C in the door closing direction DC from the intermediate position causes the follower FL and damper body PB to be moved outwardly toward the outer end CO of the lever C which, in turn, causes the damper piston PP to move toward its retracted position to activate the damper P and provide damping force DF. When the lever C reaches its first (door-closed) position (FIG. 3A), the follower FL engages the cam lobe AE2 which is shaped such that the return force RF of the return spring RS acting on the lobe AE2 through the follower FL induces a secondary closing force CF in the lever C to help maintain the over door D in its closed position. Alternatively, cam lobe AE1 is extended so that the roller RR stays on the lobe AE1 or rests partially between lobes AE1 and AE2. As noted above, the follower roller RR and yoke Y can be omitted such that the follower FL comprises and is provided directly by the damper body inner end PB1 when the damper body inner end PB1 contacts the cam edge AE.

Figure 4:
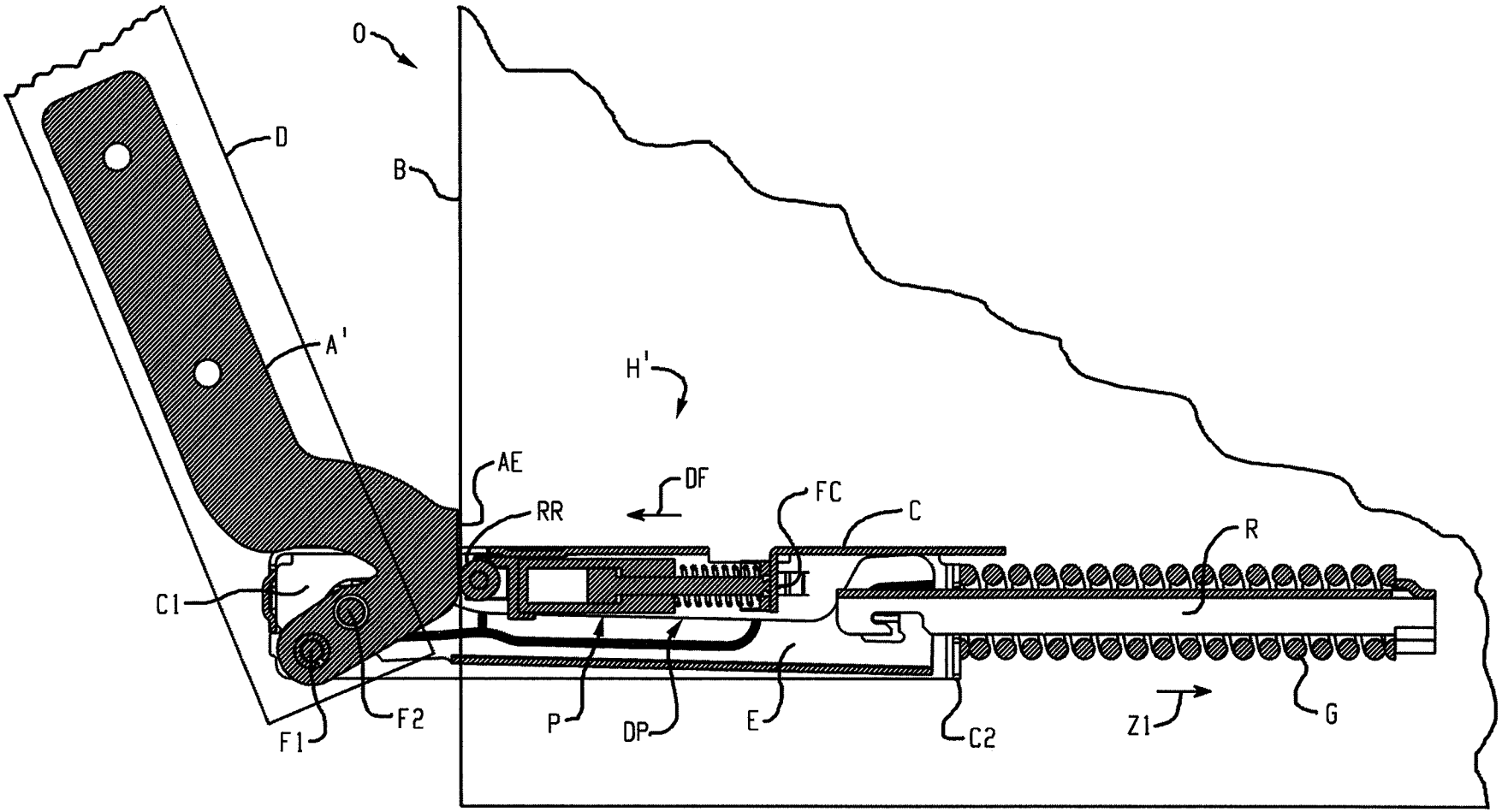
FIG. 4 illustrates an alternative embodiment of a hinge assembly H' that is identical to the hinge assembly H of FIGS. 1-3C except as otherwise shown and/or described.

FIG. 4 illustrates a hinge assembly H' that is identical to the hinge assembly H of FIGS. 1-3C except as otherwise shown and/or described. Like components relative to the hinge assembly H are identified with like reference characters. In particular, the hinge assembly H' is configured to be assembled to an oven O in a reverse orientation as compared to that described in relation to the hinge assembly H such that the arm A' is connected to the oven door D and the channel or lever C is secured to the oven body B. The arm A' comprises a different size and shape as compared to the arm A so that the arm A' is configured to be secured to the over door D or a receiver in the door D instead of the receiver RC. The arm A' comprises the cam edge AE as described above in relation to the arm A.

Figure 5A:
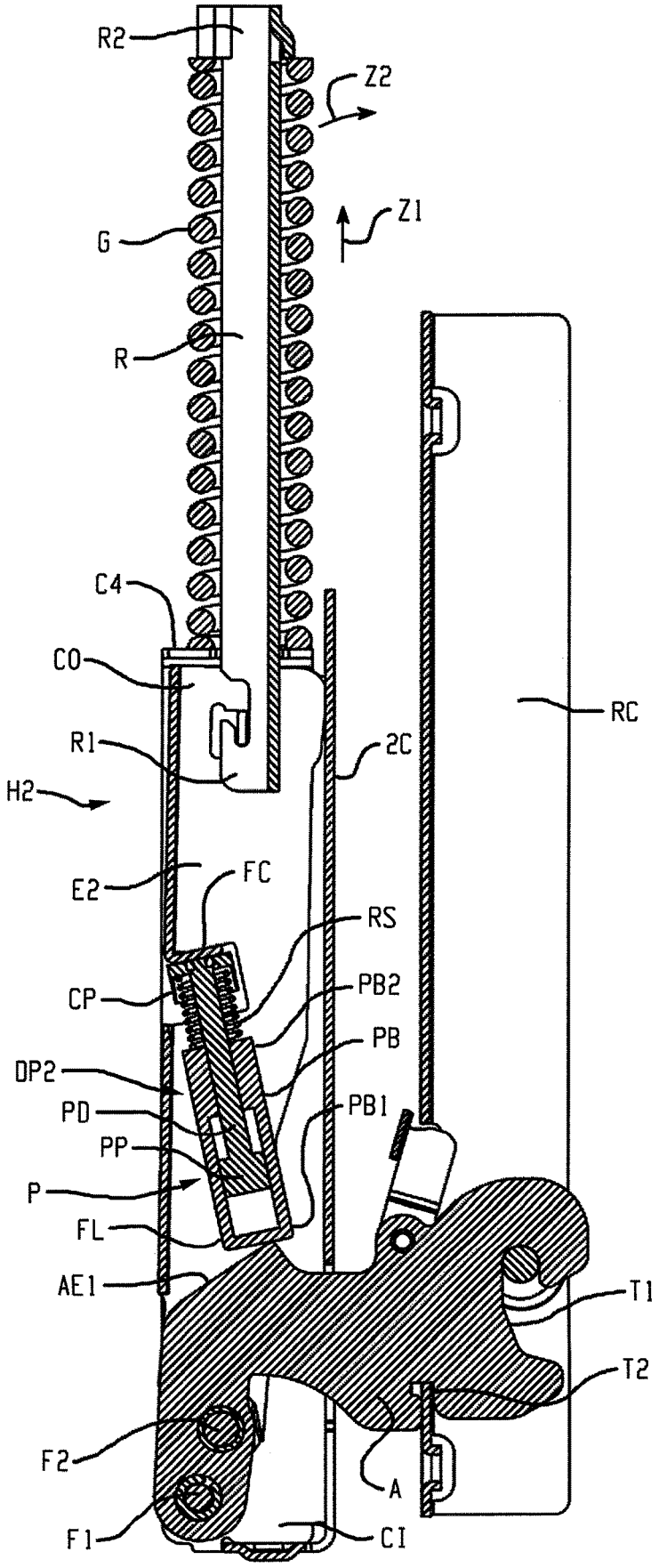
FIGS. 5A and 5B are side section views of another alternative hinge assembly H2 that is identical to the hinge assembly H except as otherwise shown and/or described.
Figure 5B:
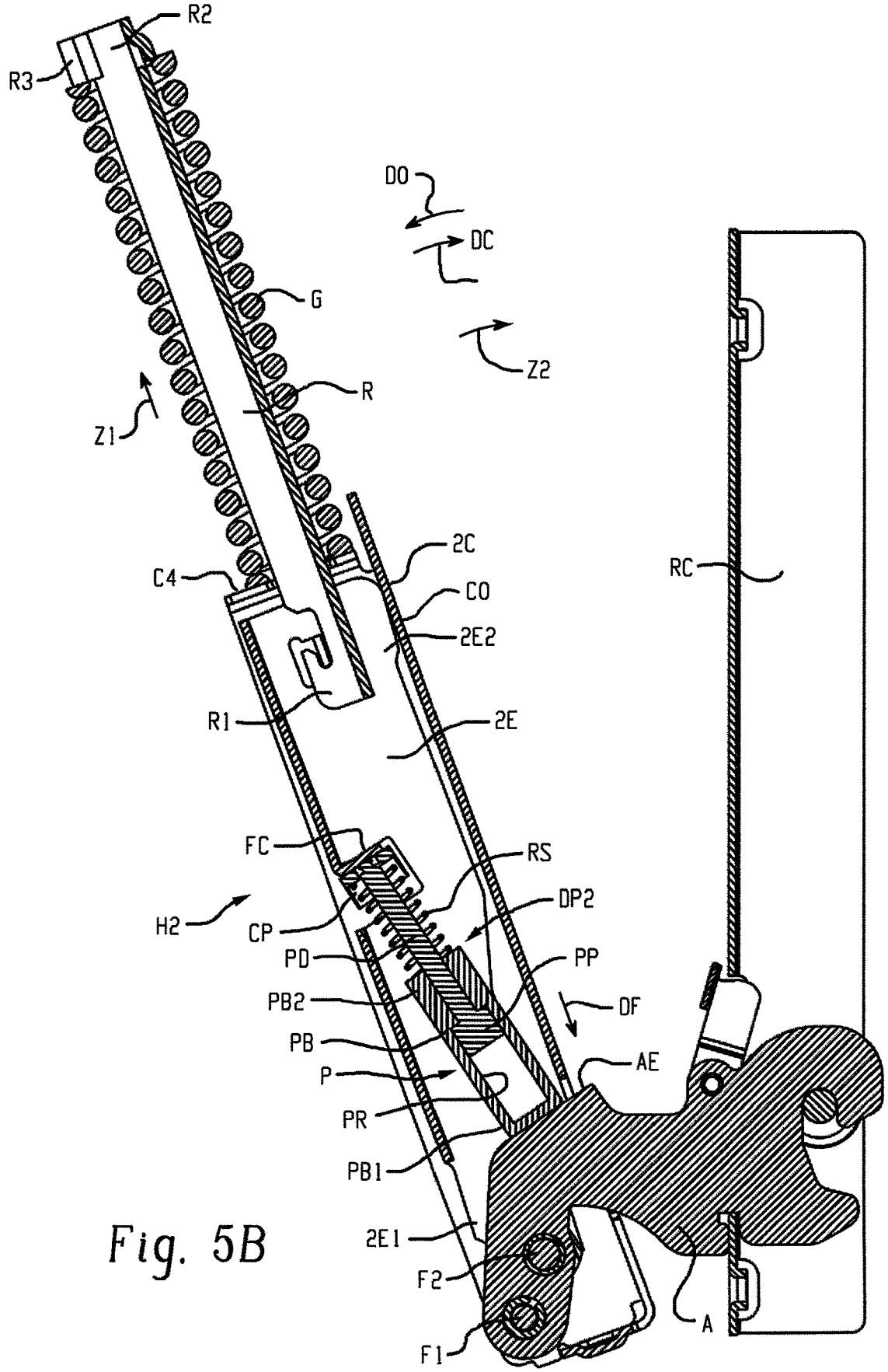

FIGS. 5A and 5B are side section views of an alternative hinge assembly H2 that is identical to the hinge assembly H except as otherwise shown and/or described herein. Like components relative to the hinge assembly H are identified with like reference characters. The door mounting lever C of the hinge assembly H is renumbered as 2C and is identical to the door mounting lever C except as otherwise shown and/or described. The hinge assembly H2 is shown in its intermediate position. The hinge assembly H2 comprises a damper system DP2 that differs from the damper system DP described above in relation to the hinge assembly H. In the damper system DP2, the rod PD of the damper P and the damper P, itself, are operably connected to slide link 2E instead of the lever 2C. As such, the damper P is indirectly connected to the lever 2C by way of the slide link 2E. The damper P moves with the slide link 2E relative to the lever 2C when the lever 2C is pivoted about the main pivot axis X. Slide link 2E is otherwise similar to the slide link E described above and comprising opposite inner and outer ends 2E1,2E2. The yoke Y and roller RR of the hinge assembly H are optionally omitted as shown and, instead, the inner end PB1 of the damper body PB defines or provides the follower FL that engages the cam edge AE of the arm A, i.e., the damper body PB directly engages the cam edge AE. Alternatively, the yoke Y and roller RR are included on the damper body PB as described above for the hinge assembly H. The follower portion FL of the damper body PB remains in contact with the cam edge AE between the first (door-closed) position (FIG. 5A) and the intermediate position (FIG. 5B) of the lever 2C as the lever 2C moves in the door opening direction DO, but the follower portion FL of the damper body PB will separate and disengage from the cam edge AE between the intermediate position (FIG. 5B) and the second (door-opened) position of the lever 2C. During pivot movement of the mounting lever 2C in the door closing direction DC, contact between the inner end P1 of the damper P and the arm A moves the damper body PB relative to the piston PP so that the piston PP moves toward its retracted position and the damper P exerts a damping force DF between the mounting lever 2C and the arm A through the slide link 2E that counteracts the biasing force Z1 and closing force Z2 of the spring G to slow and damp movement of the mounting lever 2C in the door closing direction DC.

Figure 6B:
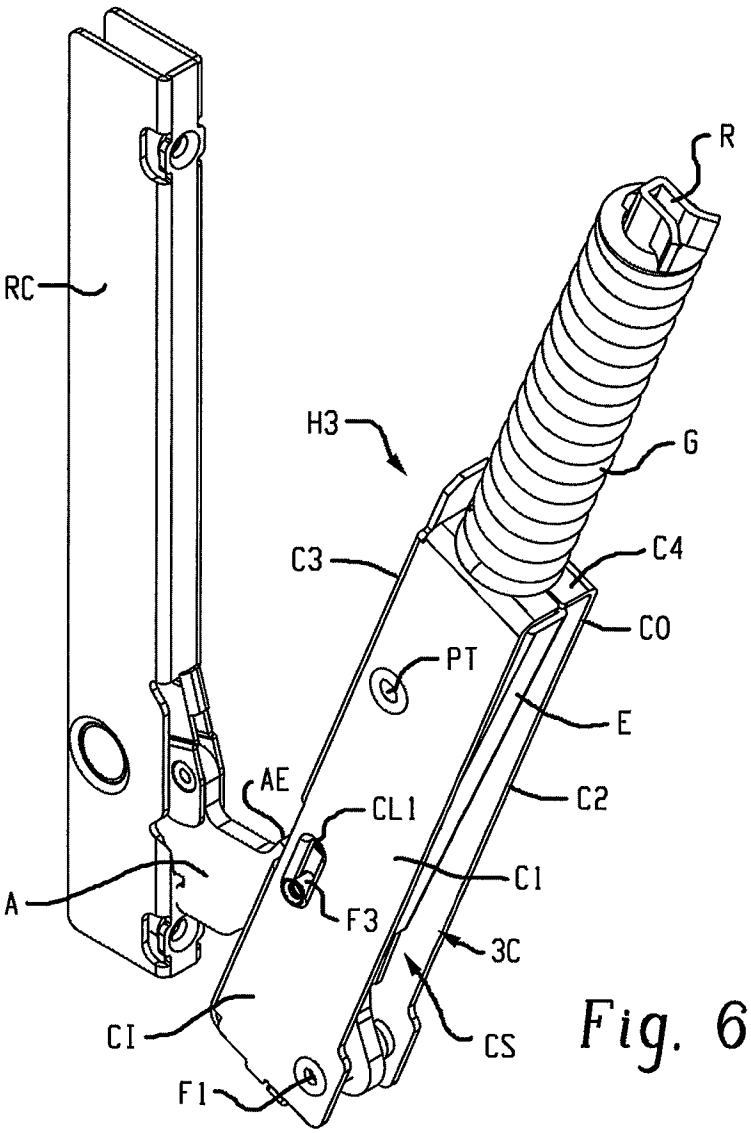
FIGS. 6A and 6B are respective right and left side isometric views of a hinge assembly H3 formed in accordance with a further alternative embodiment that is identical to the hinge assembly H of FIGS. 1-3C except as otherwise shown and/or described.
Figure 6A:
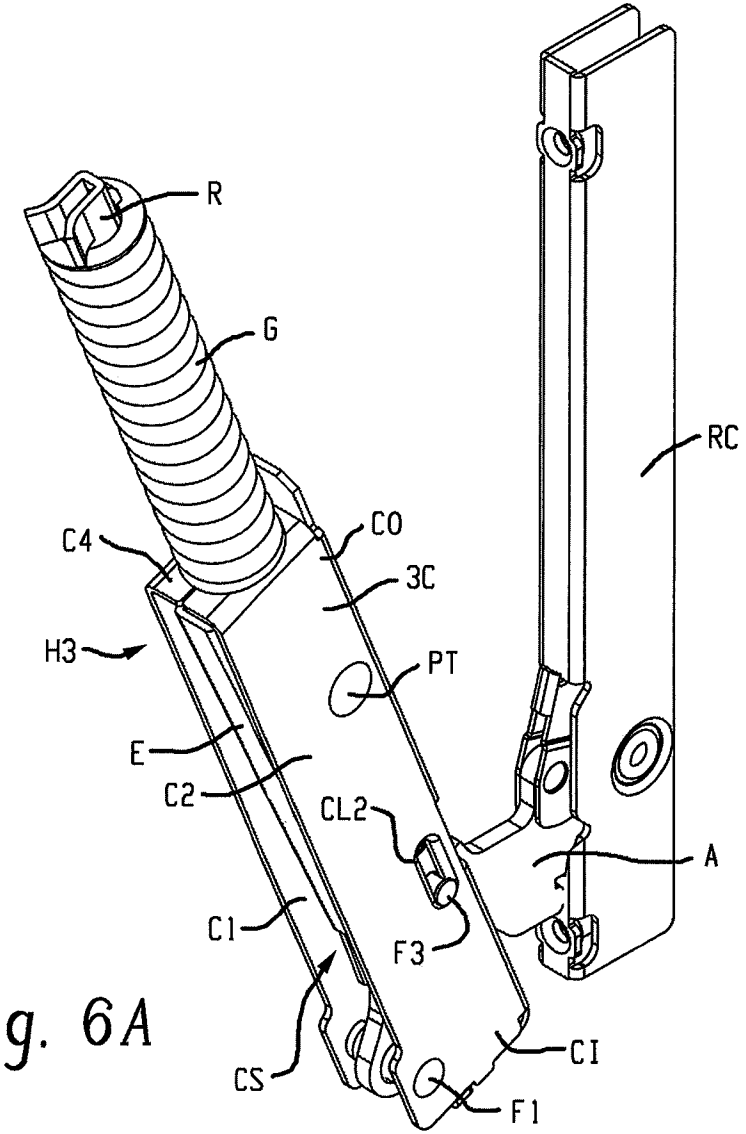
Figure 7:
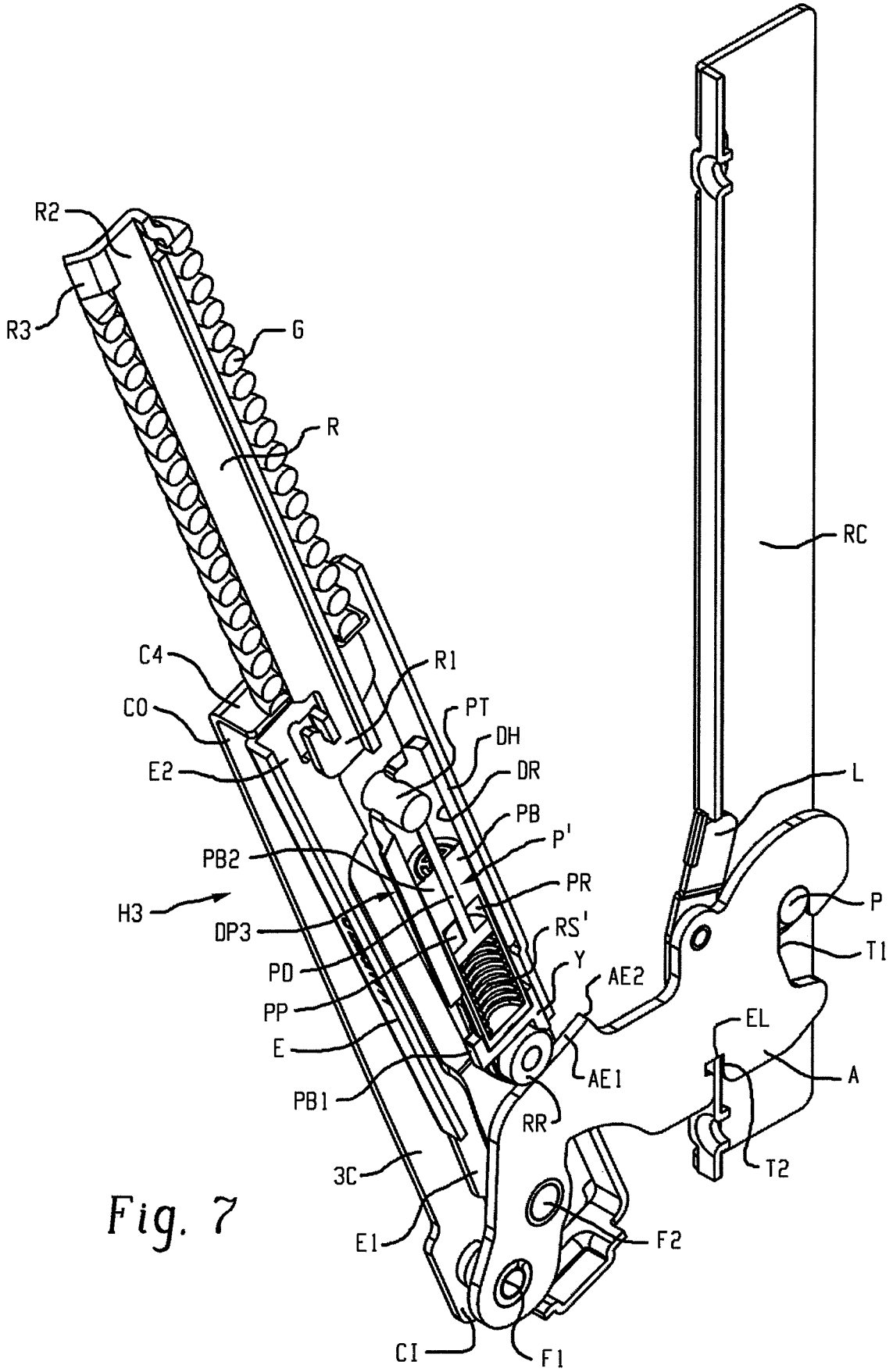
FIG. 7 is an isometric section view of the hinge assembly H3 of FIGS. 6A and 6B.

FIGS. 6A and 6B are respective right and left side isometric views of a hinge assembly H3 formed in accordance with a further alternative embodiment that is identical to the hinge assembly H of FIGS. 1-3C except as otherwise shown and/or described. The door mounting lever C of the hinge assembly H is renumbered as 3C and is identical to the door mounting lever C except as otherwise shown and/or described. Like components relative to the hinge assembly H are identified with like reference characters. FIG. 7 is an isometric section view of the hinge assembly H3, and FIGS. 7A-7C correspond respectively to FIGS. 3A-3C and show the hinge assembly H3 in its first, intermediate, and second operative positions, respectively.

The hinge assembly H3 differs from the hinge assembly H in that it includes a damper system DP3 in place of the damper system DP. In particular, the damper system DP3 comprises a damper housing DH provided by a molded polymeric structure or metal structure. The damper housing DH is connected and fixedly secured to the lever 3C by a damper fastener PT such as a rivet, pin, screw, and/or by another structure or means. The damper fastener PT can also be referred to as a damper rivet PT. The damper housing DH includes a bore DR in which the damper P' is positioned and slidably supported. The damper P' is identical to the damper P described above except that the external return spring RS is omitted and replaced by an internal return spring RS' located in the damper bore PR between the piston PP and the inner end PB1 of the damper body. Accordingly, like reference characters are used to designate like components. The return spring RS' biases the piston PP to its extended position in which the piston rod PD extends outwardly from the damper body PB a greater distance as compared to the retracted position of the piston PP. The outer end of the piston rod PD is abutted with the damper fastener PT such that the damper fastener provides a reaction member for the damper P.

Figure 7A:
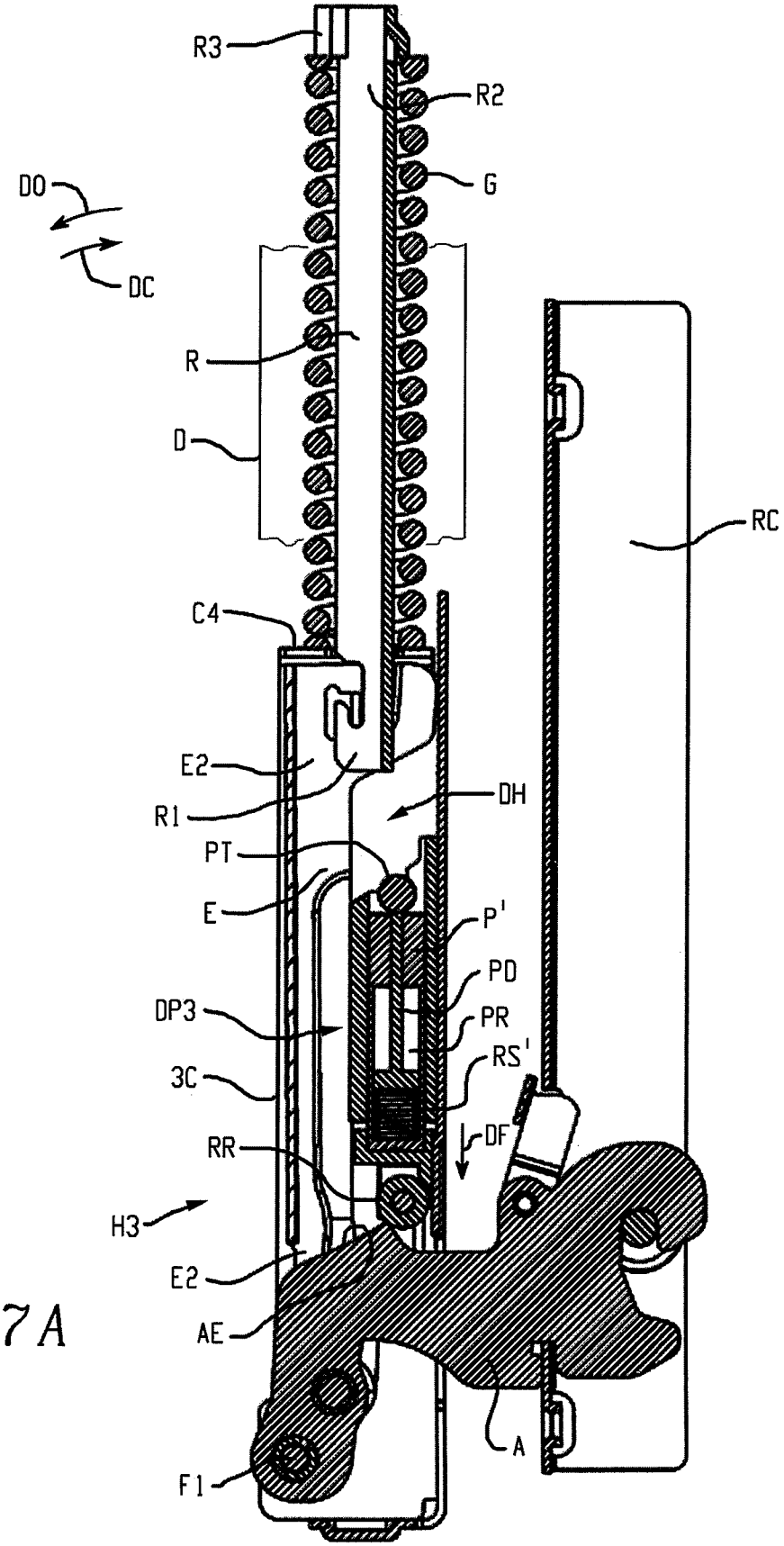
FIGS. 7A, 7B, and 7C correspond respectively to FIGS. 3A, 3B, and 3C and show the hinge assembly H3 in its first, intermediate, and second operative positions, respectively.
Figure 7B:
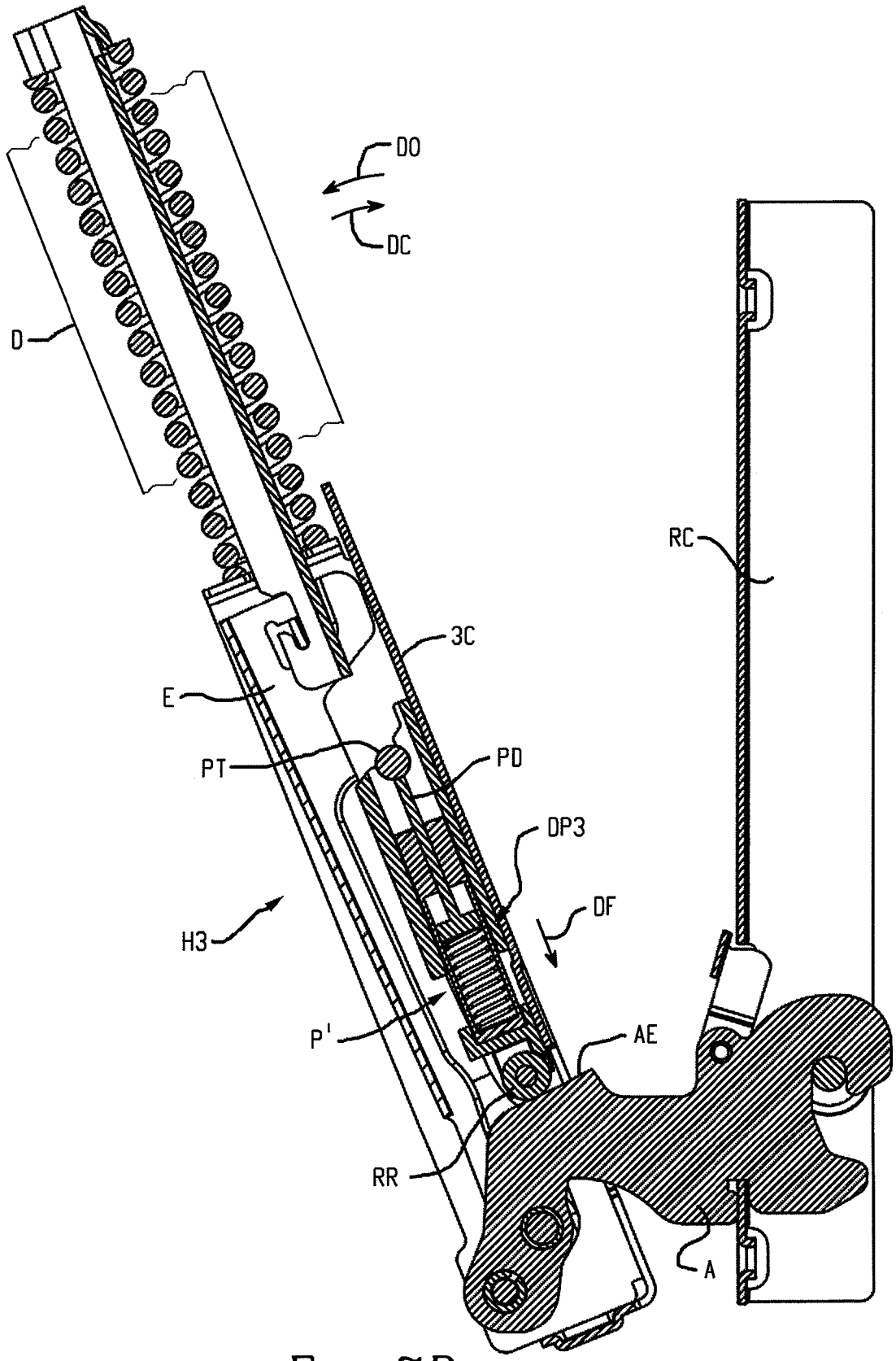
Figure 7C:
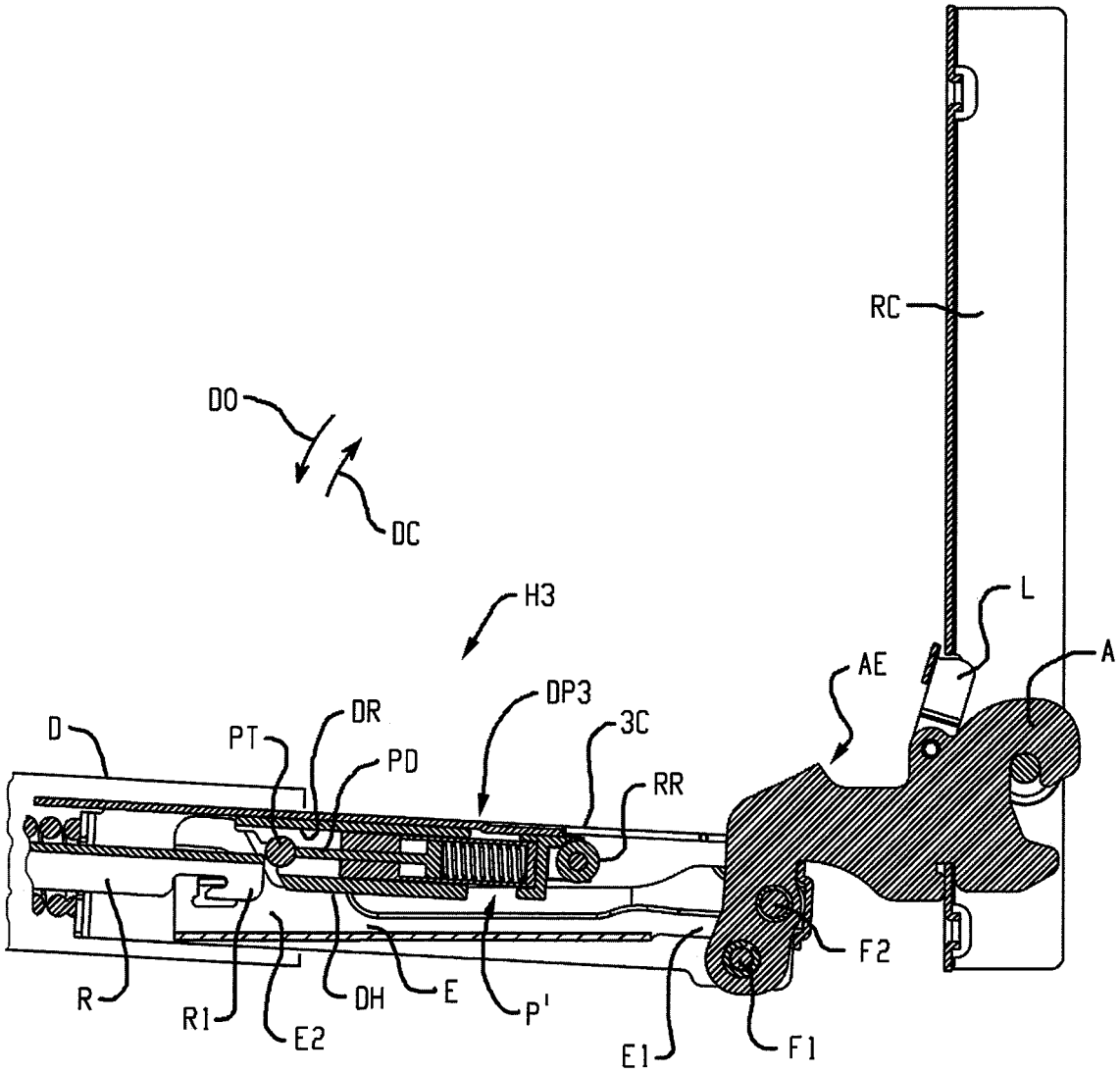

In use, when the oven door D is pivoted from its opened position (FIG. 7C) toward its closed position (FIG. 7A), the damper follower FL (roller RR in the illustrated example) moves into contact with the cam edge AE of the arm A and the damper P exerts a damping force DF to slow and damp closing movement of the door D as described above in relation to the hinge assembly H. Contact between the roller RR and the cam edge AE urges and causes the damper body PB to move relative to the damper housing DH in the housing bore DR toward the damper fastener PT while the piston PP is blocked from movement by contact between the piston rod PD and the damper fastener PT. This results in relative movement between the damper body PB and piston PP causing the piston PP to assume its retracted position as shown in FIG. 7A. Upon movement of the door D in the door opening direction DO, the roller RR will separate from the cam edge AE before the lever 3C reaches its second (door-opened) position, and the return spring RS' will reset the damper P' by moving the damper body PB relative to the piston PP away from the damper fastener PT so that the piston PP again assumes its extended position.

Figure 8B:
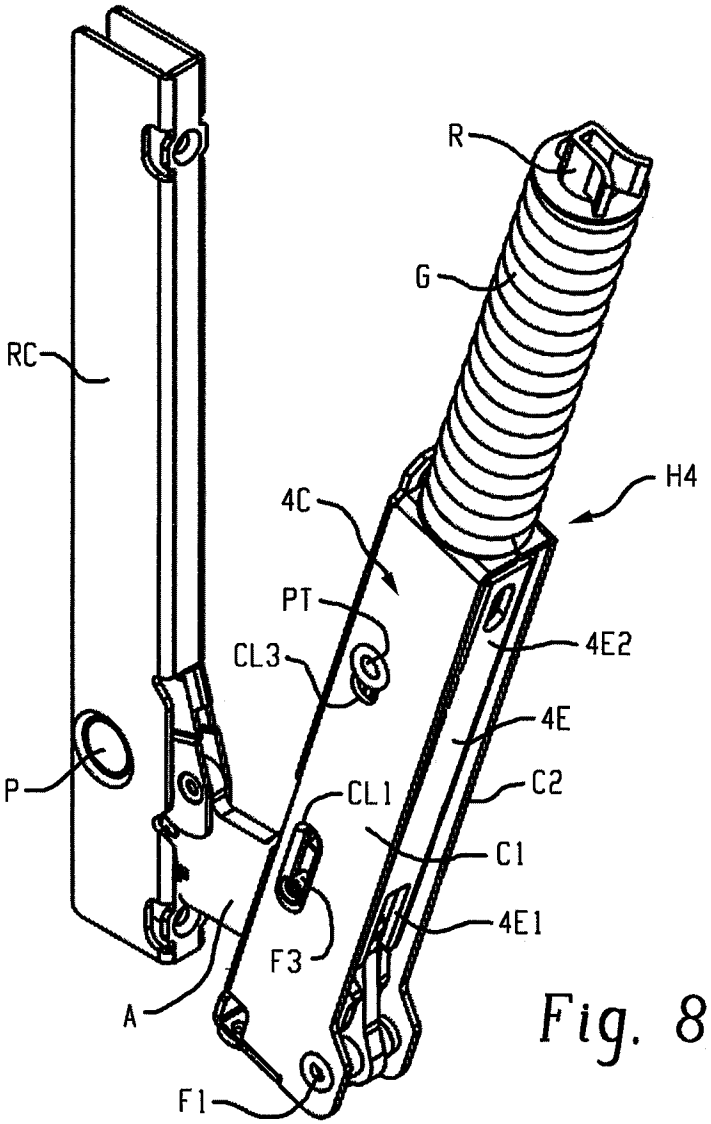
FIGS. 8A and 8B are respective right and left side isometric views of a hinge assembly H4 formed in accordance with a further alternative embodiment that is identical to the hinge assembly H3 of FIGS. 6A and 6B except as otherwise shown and/or described.
Figure 8A:
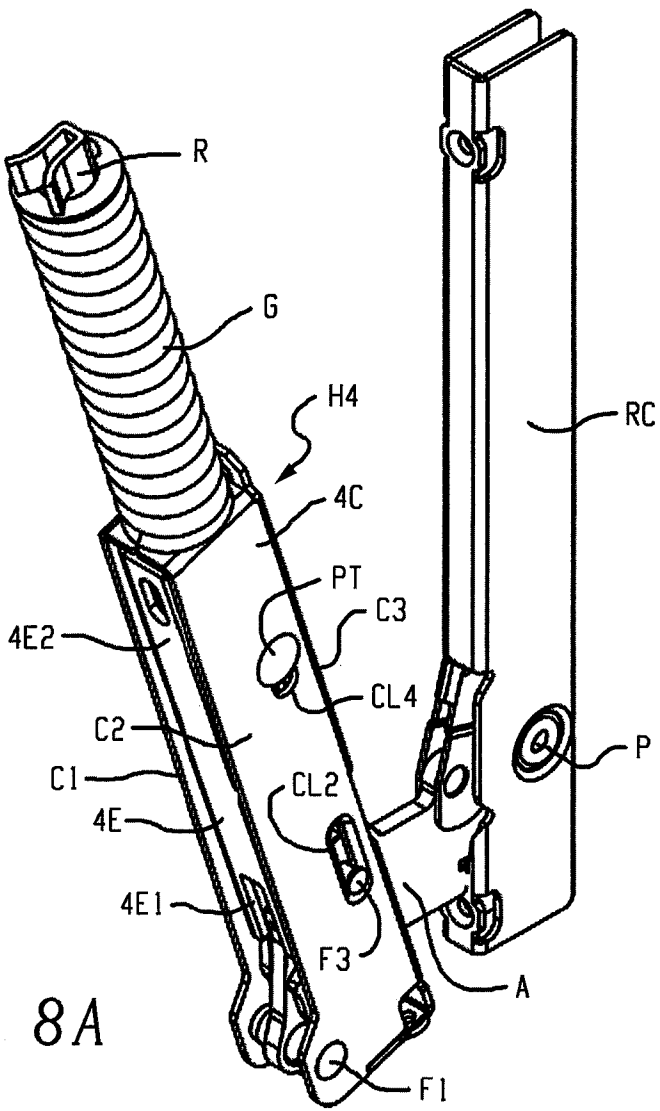
Figure 9:
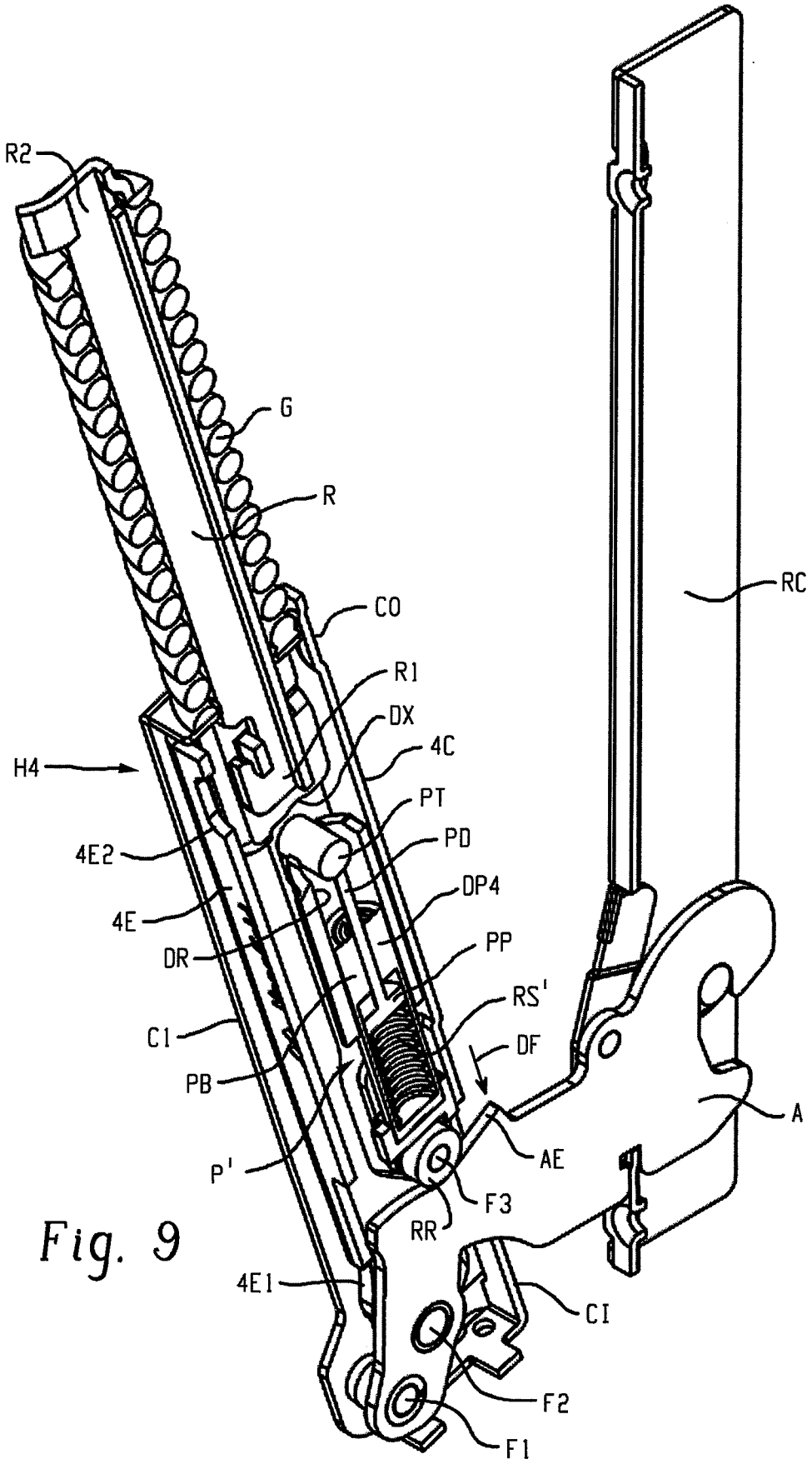
FIG. 9 is an isometric section view of the hinge assembly H4 of FIGS. 8A and 8B.
Figure 9A:
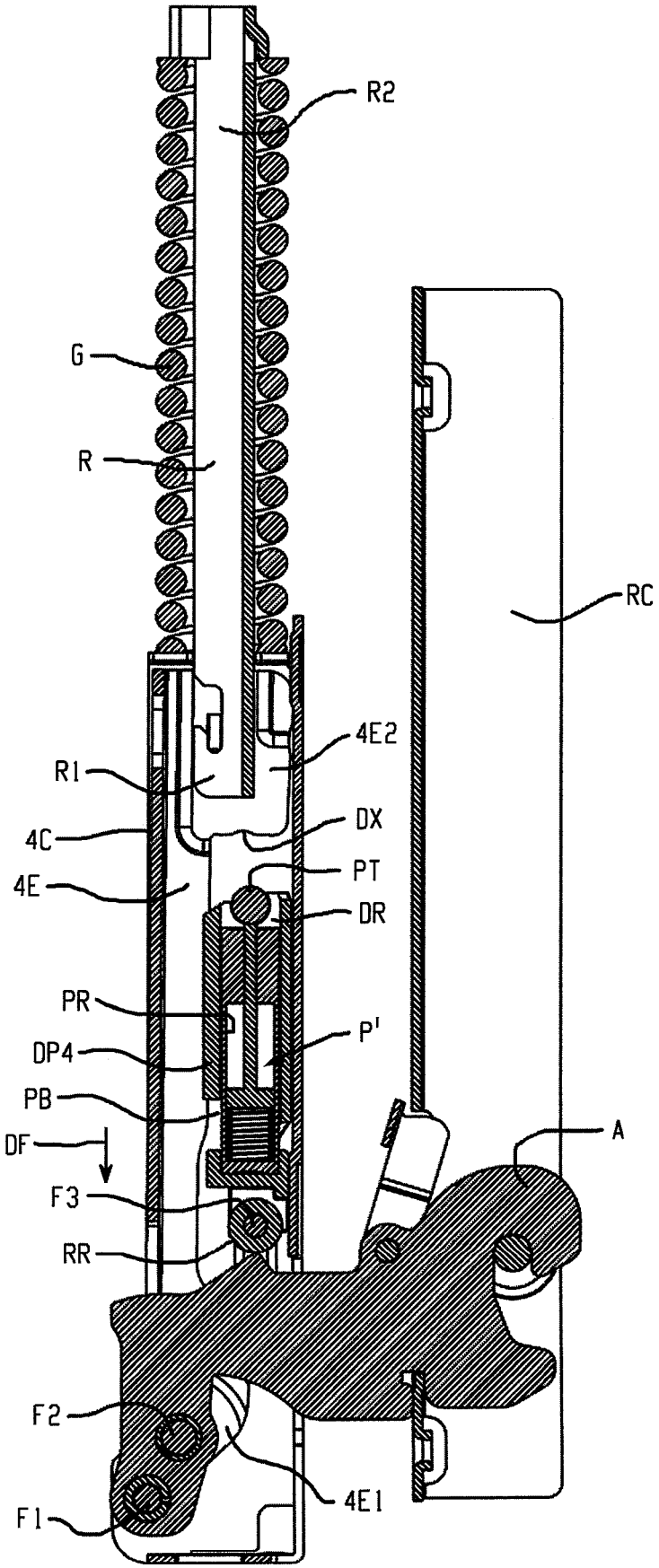
FIGS. 9A, 9B, and 9C correspond respectively to FIGS. 7A, 7B, and 7C and show the hinge assembly H4 in its first, intermediate, and second operative positions, respectively.

FIGS. 8A and 8B are respective right and left side isometric views of a hinge assembly H4 formed in accordance with another alternative embodiment that is identical to the hinge assembly H3 of FIGS. 6A-7C except as otherwise shown and/or described. The door mounting lever 3C of the hinge assembly H3 is renumbered as 4C and is identical to the door mounting lever 3C except as otherwise shown and/or described. Like components of the hinge assembly H4 relative to the hinge assembly H3 are identified with like reference characters, and the structure and operation of certain components is not repeated here. FIG. 9 is an isometric section view of the hinge assembly H4, and FIGS. 9A-9C correspond respectively to FIGS. 7A-7C and show the hinge assembly H4 in its first, intermediate, and second operative positions, respectively. FIG. 9D is similar to FIG. 9C but shows the hinge assembly H4 in a second intermediate position located between the intermediate position of FIG. 9B and the fully opened position of FIG. 9C.

Figure 9B:
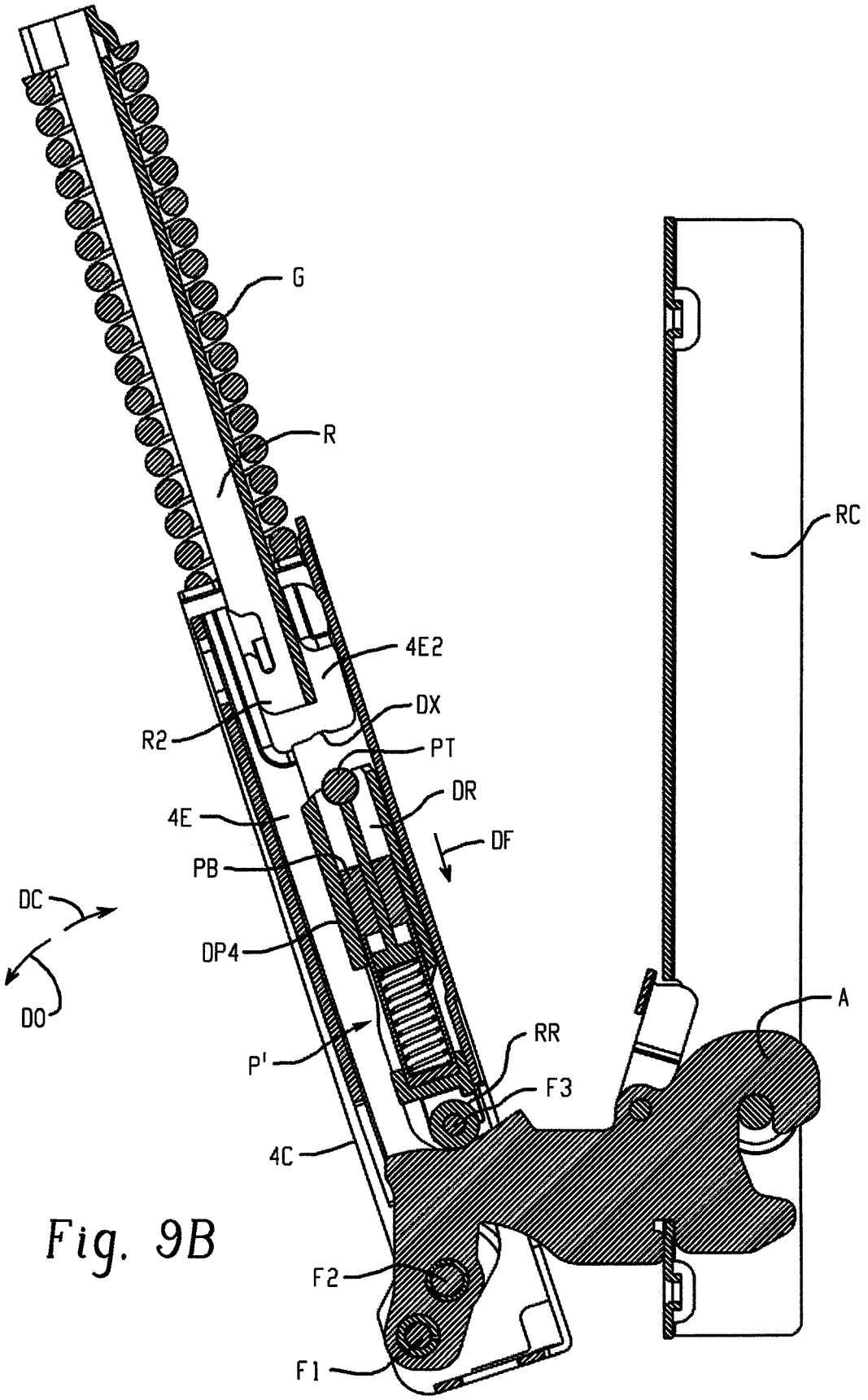
Figure 9C:
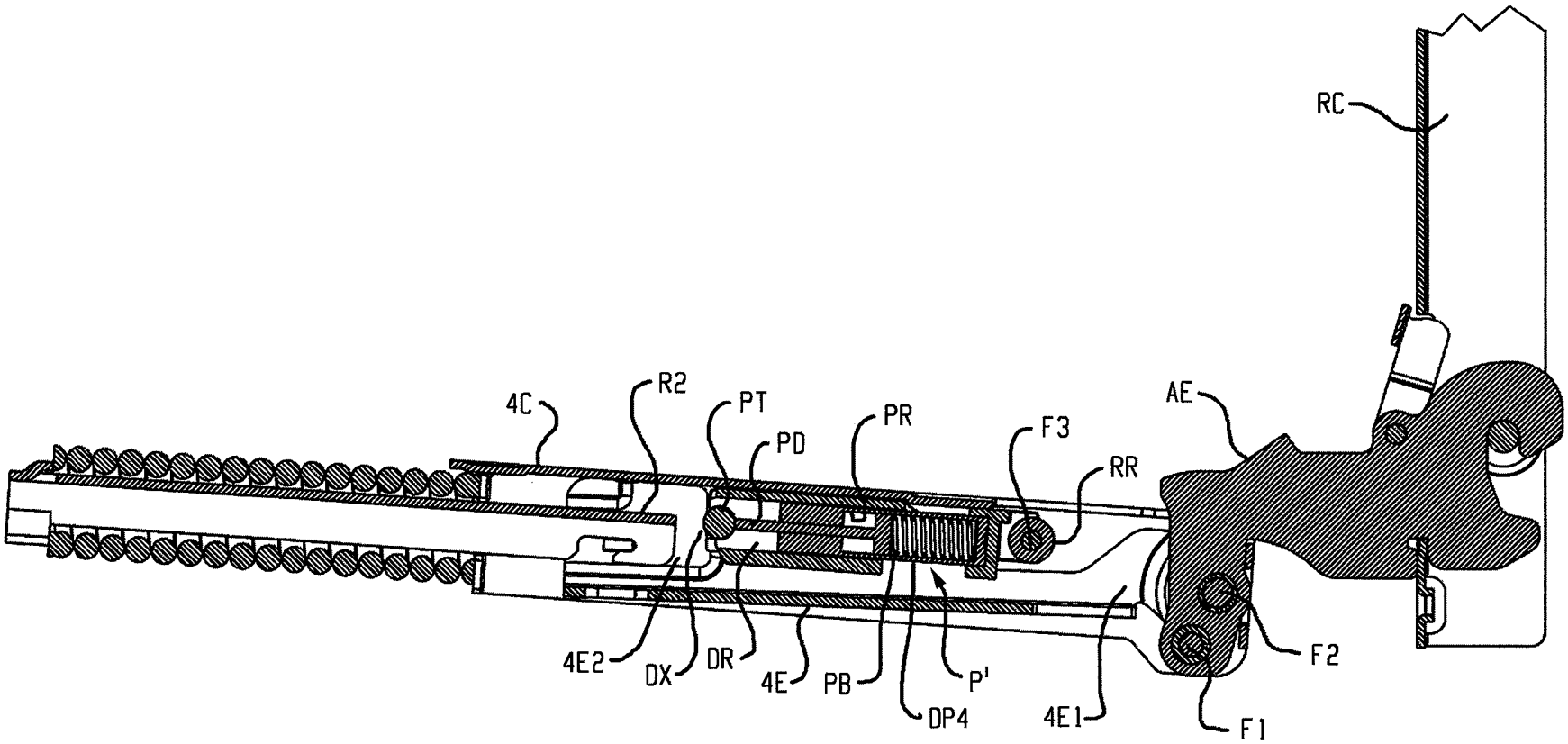
Figure 9D:
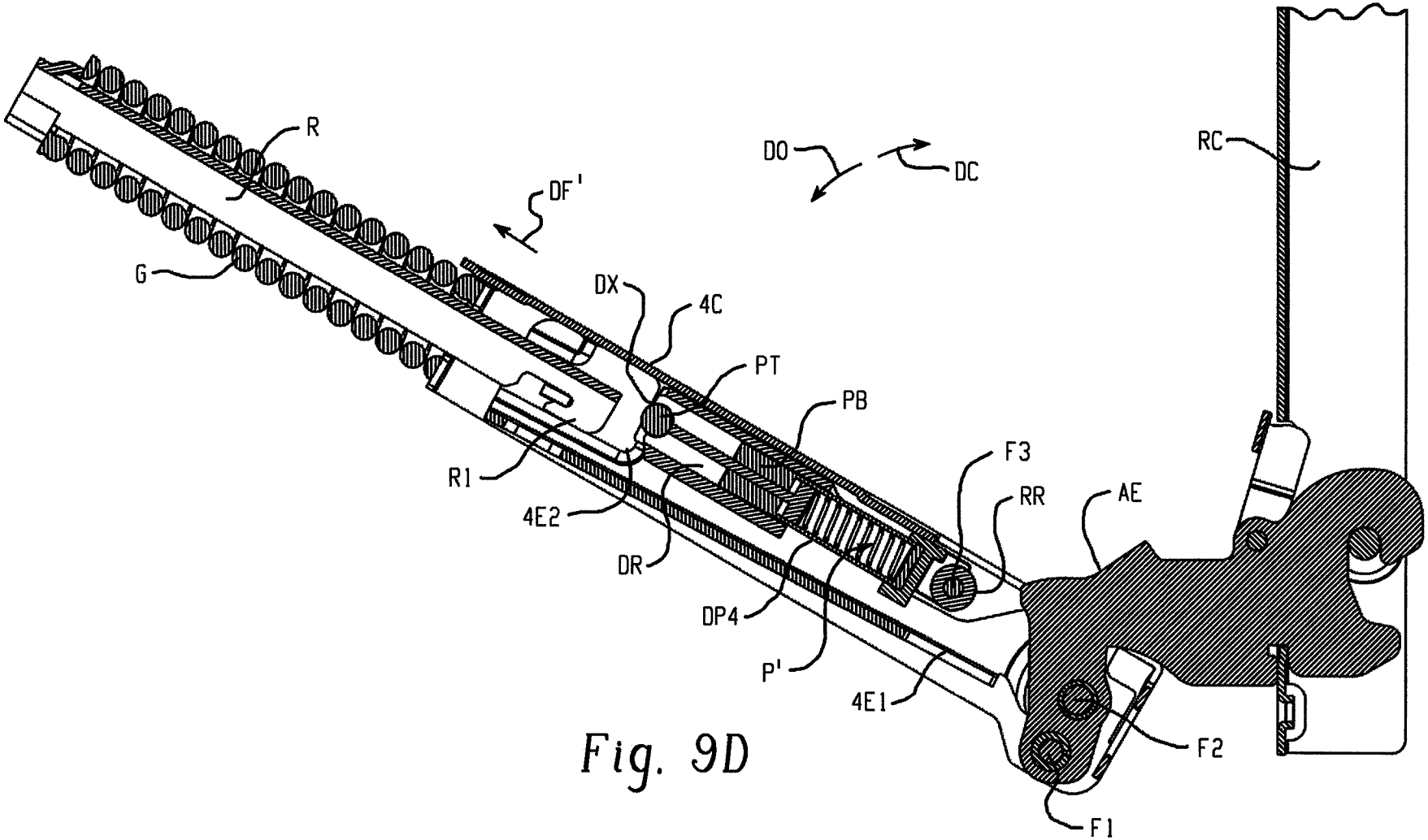
FIG. 9D is similar to FIG. 9C but shows the hinge assembly H4 in a second intermediate position located between the intermediate position of FIG. 9B and the fully opened position of FIG. 9C and illustrating a soft open feature of the hinge assembly.

The hinge assembly H4 differs from the hinge assembly H3 in that it is adapted to provide additional damping upon movement of the door mounting lever 4C from its first operative position (corresponding to the door D being closed) toward its second operative position (corresponding to the door D being opened) to provide slow open characteristics to the hinge assembly H4 and/or to provide additional counterbalance force beyond that provided by spring G to balance the appliance door D in a second intermediate position (FIG. 9D) where the door mounting lever is located between the intermediate position of FIG. 9B and the second operative position of FIG. 9C. In this sense, the damper P' is double-acting and provides damping upon pivoting movement of the door mounting lever 4C in both the door closing direction DC and door opening direction DO.

In particular, the hinge assembly H4 includes a damper system DP4 that is identical to the damper system DP3 except that the damper fastener PT and preferably also the damper housing DH are slidably engaged with the door mounting lever 4C. As shown in FIGS. 8A and 8B, the first and second side walls C1,C2 of the door mounting lever 4C include respective third and fourth elongated slots CL3,CL4, in addition to the first and second elongated slots CL1,CL2 described above. The third and fourth elongated slots CL3, CL4 are respectively spaced from the first and second slots CL1,CL2 and each extend linearly along respective axes that lie parallel to the central axis of the damper bore PR and that are respectively coincident with the axes of the first and second slots C11,CL2 such that the first and third slots CL1,CL3 are aligned with each other and such that the second and fourth slots CL2,CL4 are aligned with each other. The opposite first and second ends of the damper fastener PT are slidably located in the respective third and fourth elongated slots CL3,CL4 such that the damper fastener PT slidably reciprocates in the slots CL3,CL4. In the illustrated embodiment, because the damper housing DH is abutted or connected to the damper fastener PT, the damper housing DH moves with the damper fastener PT when the damper fastener PT slidably reciprocates in the third and fourth slots CL3,CL4. The damper return spring RS' biases the damper fastener PT and the follower fastener F3 in opposite directions outwardly away from each other.

In use, when the oven door D and door mounting lever 4C are pivoted from the opened position (FIG. 9C) toward the closed position (FIG. 9A), the damper follower FL (roller RR in the illustrated example) moves into contact with the cam edge AE of the arm A and the damper P' exerts a damping force DF to slow and damp closing movement of the door D and mounting lever 4C as described above in relation to the hinge assembly H3. Contact between the roller RR and the cam edge AE urges and causes the damper body PB to move relative to the damper housing DH in the housing bore DR toward the damper fastener PT while the piston PP is blocked from movement in the same direction by contact between the piston rod PD and the damper fastener PT. This results in relative movement between the damper body PB and piston PP causing the piston PP to assume its retracted position as shown in FIG. 9A. Upon movement of the door D in the door opening direction DO, from the position of FIG. 9A toward the position of FIG. 9C, the roller RR will separate from the cam edge AE before the lever 4C reaches its second (door-opened) position, and the return spring RS' will reset the damper P' by moving the damper body PB relative to the piston PP away from the damper fastener PT so that the piston PP again assumes its extended position.

However, unlike the hinge assembly H3, in the hinge assembly H4, the slide link E is replaced by a slide link 4E which includes opposite inner and outer ends 4E1,4E2. The slide link 4E is identical to the slide link E except that the outer end 4E2 is conformed and dimensioned to include a damper engagement portion DX that directly contacts or directly or indirectly engages the damper fastener PT at a second intermediate position of the door mounting arm 4C as shown in FIG. 9D located between the first intermediate position of FIG. 9B and the second (door-opened) position of FIG. 9C. As described above, the piston rod PD of the damper P' is abutted or otherwise operatively engaged with the damper fastener PT. As such, after contact between the damper engagement portion DX of the slide link 4E and the damper fastener PT, further pivoting movement of the door mounting lever 4C in the door opening direction DO causes the slide link 4E to move inwardly and urge the damper fastener PT and damper piston rod PD inwardly toward the main pivot fastener F1 and toward the inner end CI of the door mounting lever 4C and toward the cam edge AE of the arm A which results in retraction of the piston PP and activation of the damper P' such that the damper P' exerts a damping force DF' between the slide link 4E and the door mounting lever 4C and counteracts the weight of the door D to slow and damp movement of the lever 4C in the door opening direction DO. It should be noted that the engagement of the follower fastener F3 in the first and second slots CL1,CL2 restrains the damper body PB relative to the door mounting lever 4C to allow the piston PP to retract relative to the damper body PB as described. As noted above, the damper engagement portion DX is shown herein as being provided as part of the slide link 4E, but the damper engagement portion DX can alternatively be provided as part of or connected to the inner end R1 of the spring rod R and operate in the same manner.

Figure 10A:
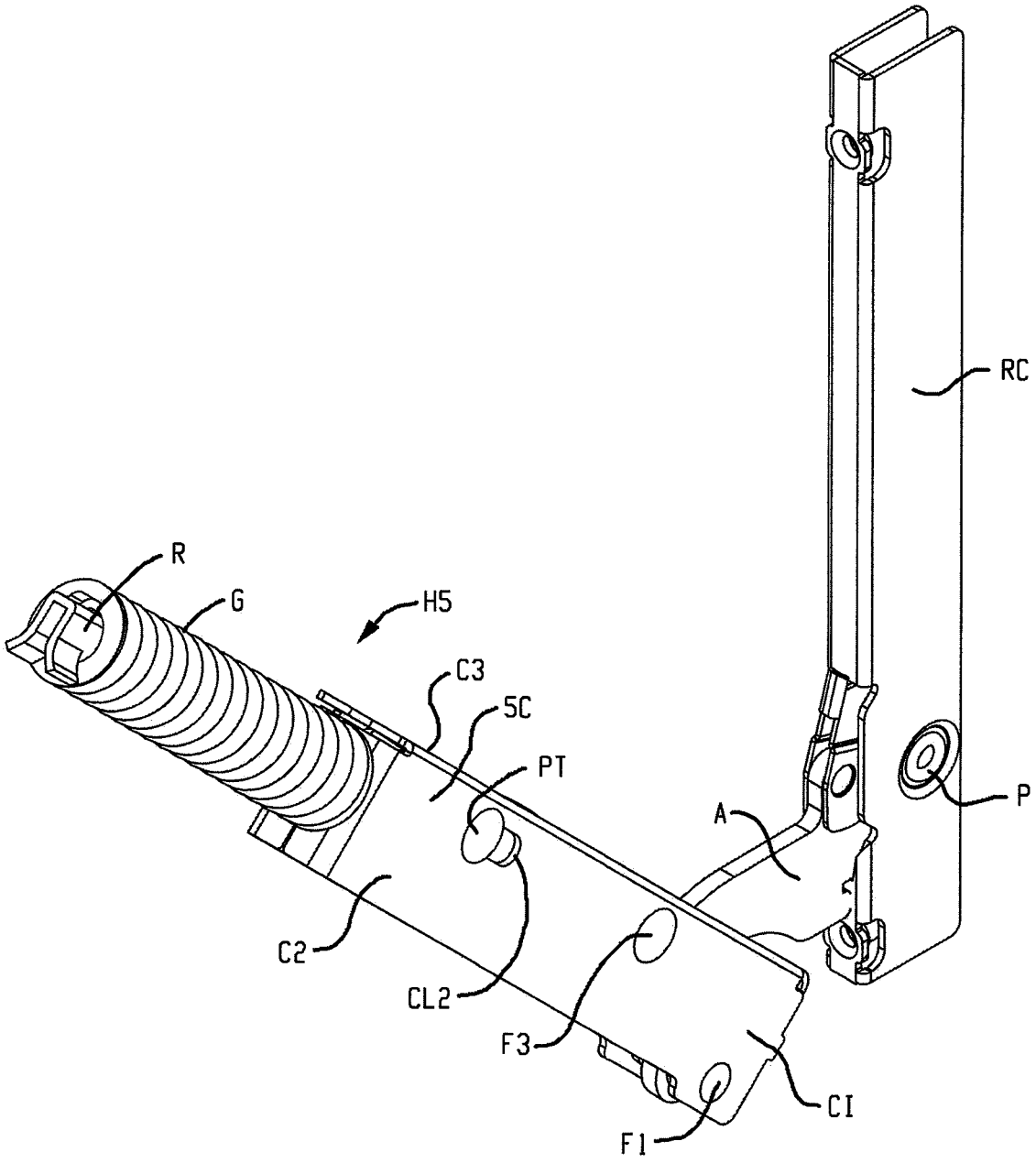
FIGS. 10A and 10B are respective right and left side isometric views of a hinge assembly H5 formed in accordance with a further alternative (slow open) embodiment that is identical to the hinge assembly H4 of FIGS. 8A and 8B except as otherwise shown and/or described herein (the hinge assembly H5 is shown as being operably mated with an associated receiver RC that is provided as part of and/or connected to an appliance body B)
Figure 10B:
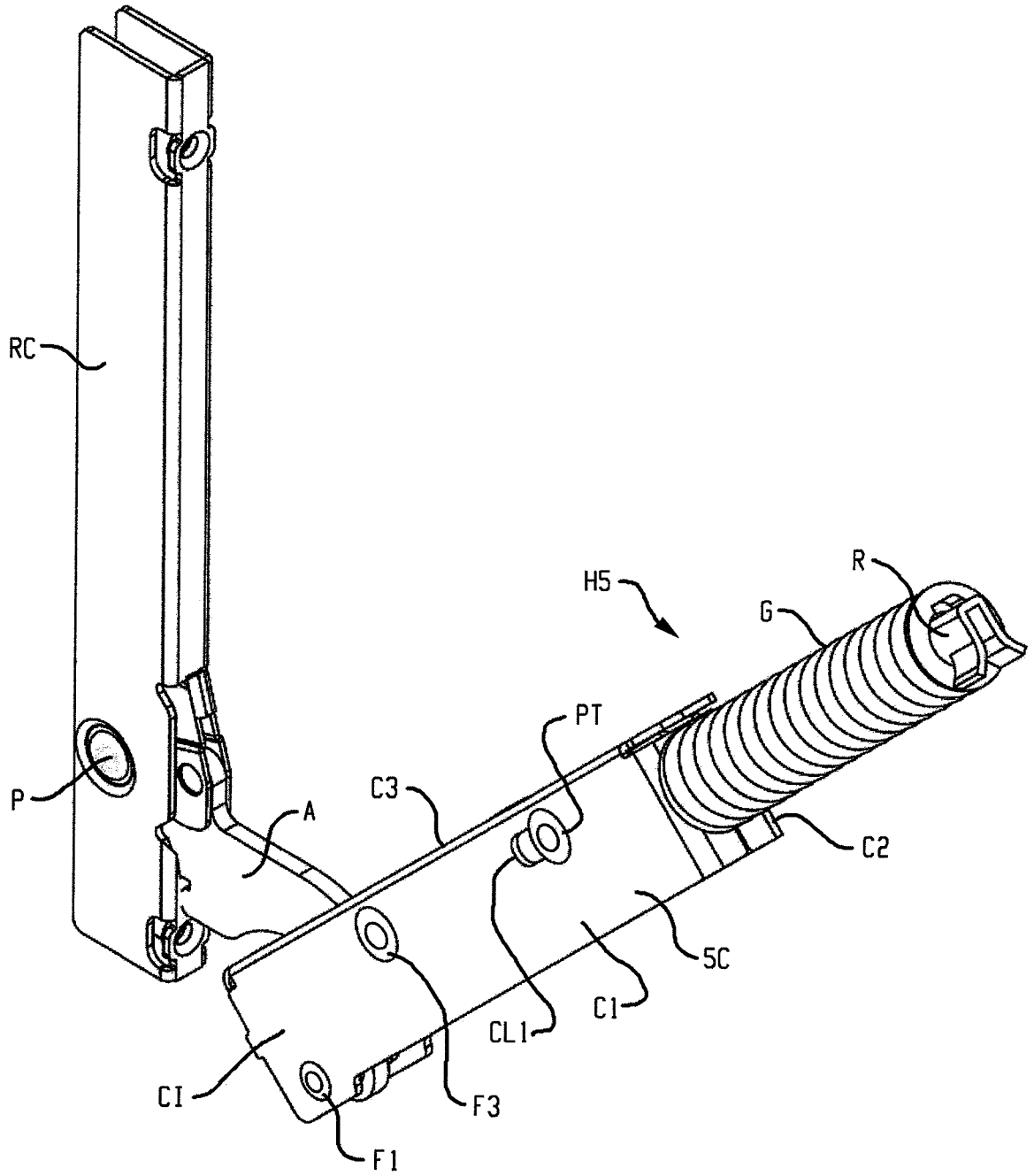
Figure 11:
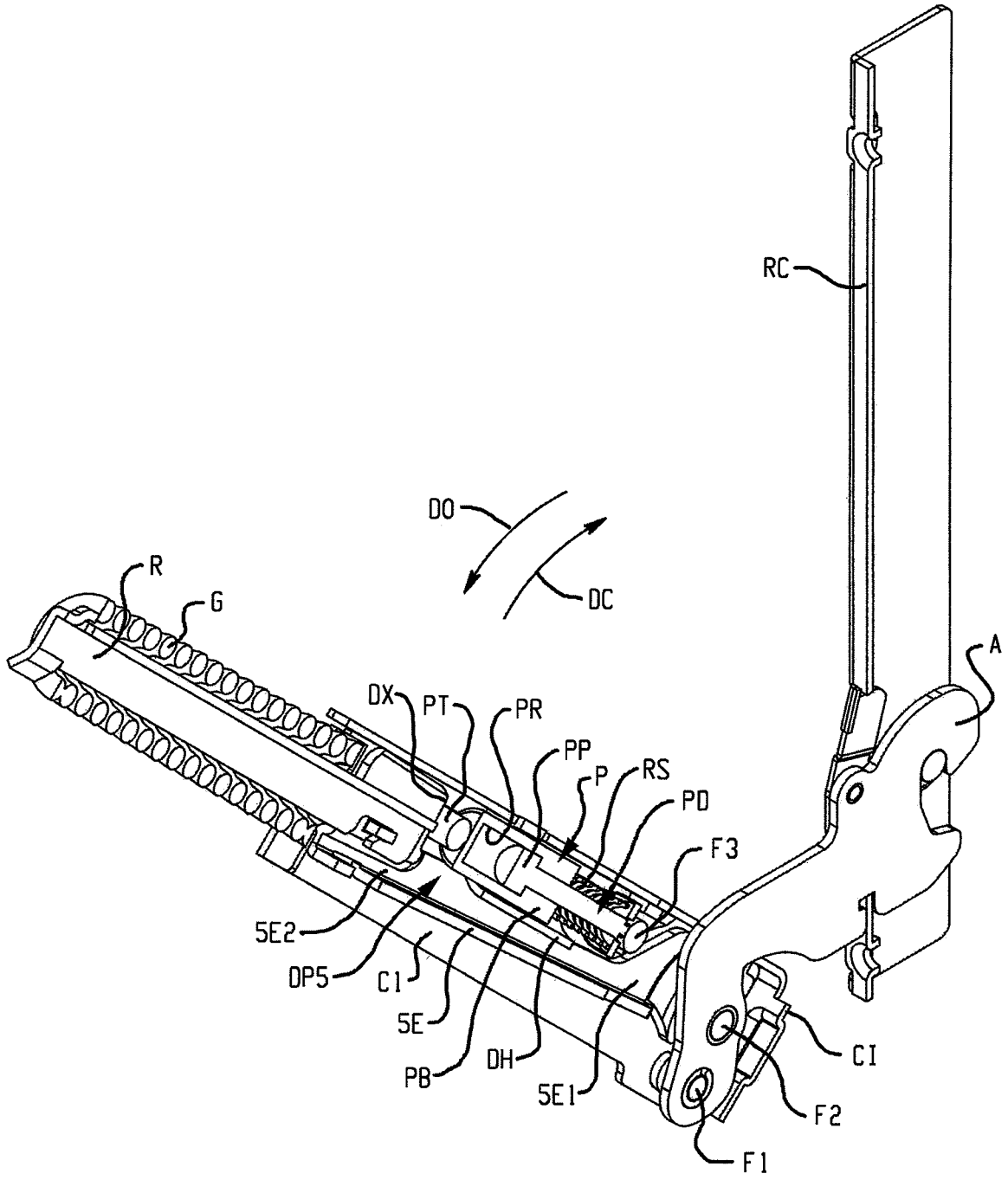
FIG. 11 is an isometric section view of the hinge assembly H5 of FIGS. 10A and 10B in its intermediate (engaged) position.

FIGS. 10A and 10B are respective right and left side isometric views of a hinge assembly H5 formed in accordance with another alternative embodiment that is identical to the hinge assembly H4 of FIGS. 8A-9D except as otherwise shown and/or described. The hinge assembly H5 is operably mated with an associated receiver RC that is provided as part of and/or connected to the appliance body B. The door mounting lever 4C of the hinge assembly H4 is renumbered as 5C for the hinge assembly H5 and the door mounting lever 5C is identical to the door mounting lever 4C except as otherwise shown and/or described. Like components of the hinge assembly H5 relative to the hinge assembly H4 are identified with like reference characters, and the structure and operation of certain components is not repeated here. FIG. 11 is an isometric section view of the hinge assembly H5, and FIGS. 11A-11C correspond respectively to FIGS. 9A-9C and show the hinge assembly H5 in its first, intermediate, and second operative positions, respectively.

Figure 11A:
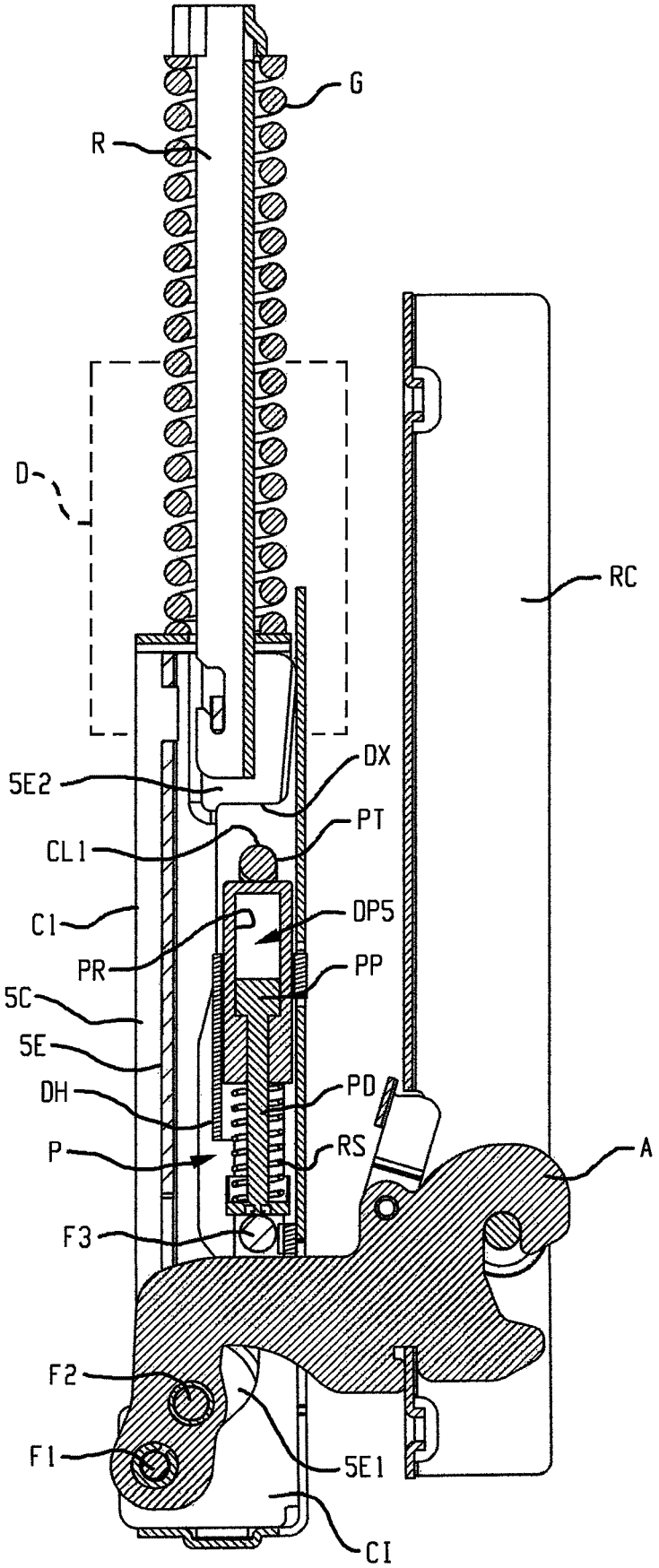
FIGS. 11A, 11B, and 11C show the hinge assembly H5 in its first operative, intermediate operative, and second operative positions, respectively.
Figure 11B:
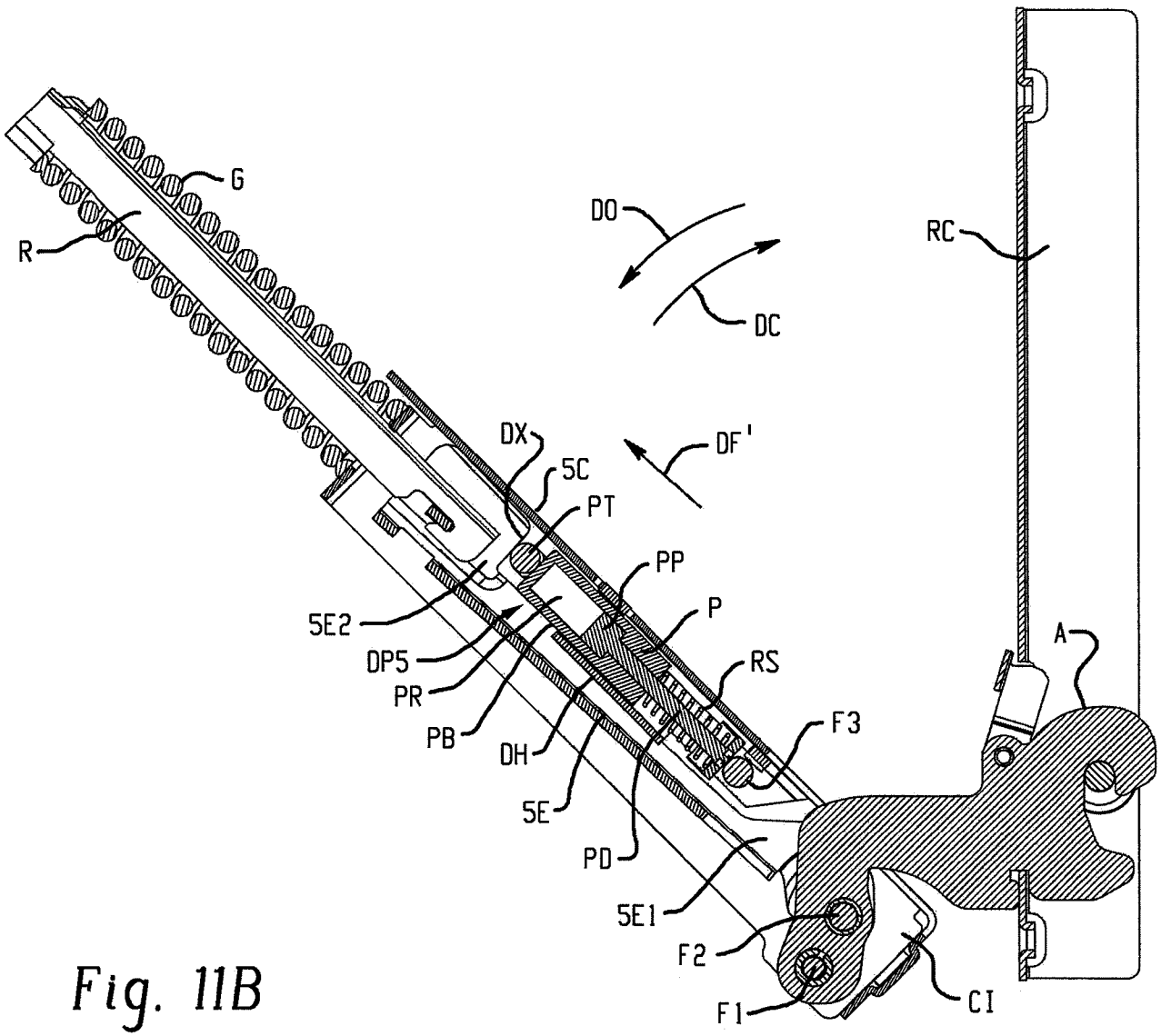
Figure 11C:
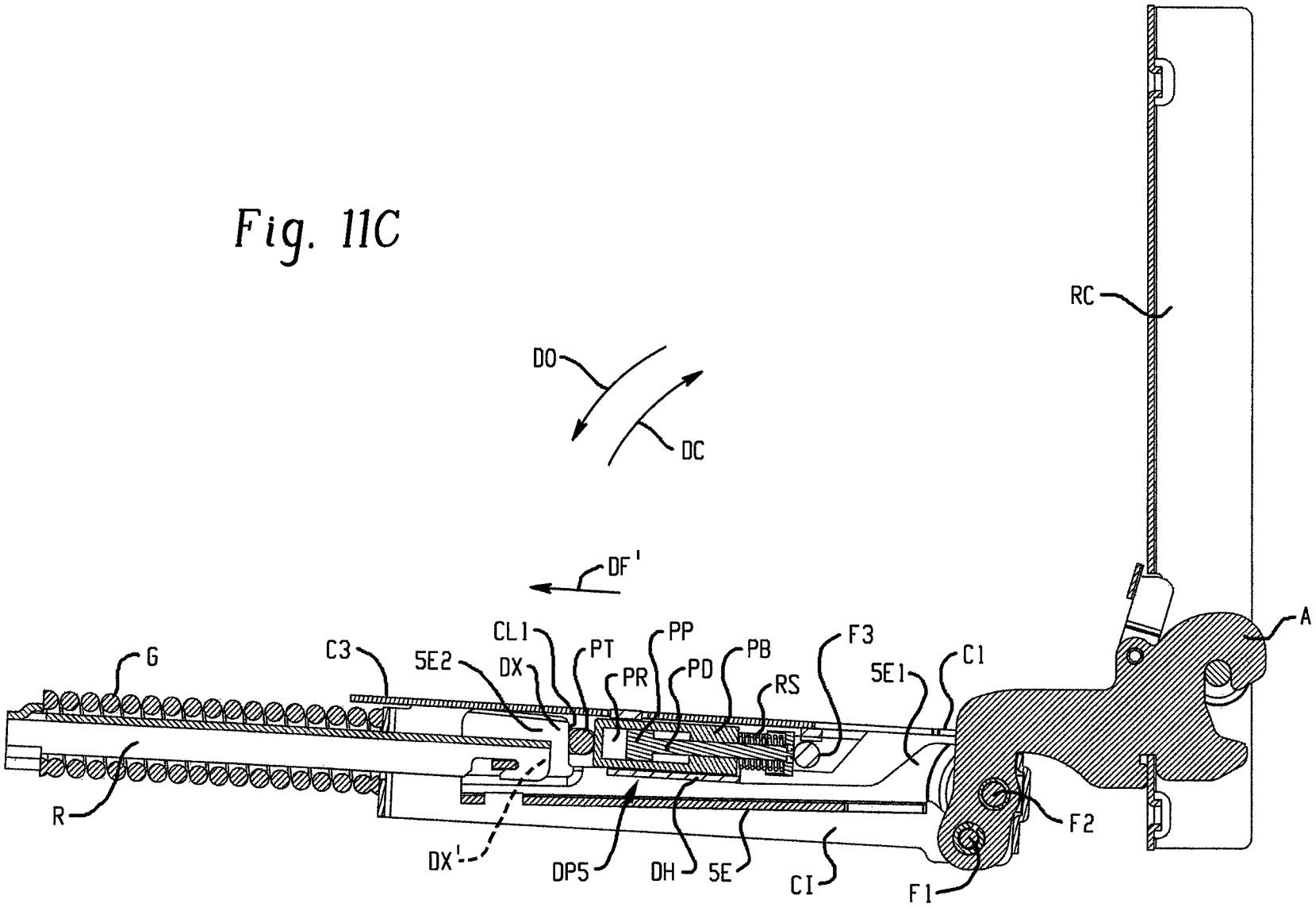

The hinge assembly H5 differs from the hinge assembly H4 in that the hinge assembly H5 is adapted to provide damping of the door mounting lever 5C and an appliance door D connected thereto upon movement of the door mounting lever 5C in the door opening direction DO toward its second operative position (corresponding to the door D being opened) to provide slow open characteristics to the hinge assembly H5 and/or to provide additional counterbalance force beyond that provided by spring G to balance the appliance door D in a partially opened or intermediate position (such as FIG. 11B) where the door mounting lever 5C is located between the first operative position of FIG. 11A and the second operative position of FIG. 11C. Unlike the hinge assembly H4, the hinge assembly H5 does not provide damping of the door mounting lever 5C upon movement of the door mounting lever 5C in the door closing direction DC toward its first operative position (corresponding to the door D being closed) such that the hinge assembly H5 does not provide any slow close characteristics. In this sense, the damper P provides damping upon pivoting movement of the door mounting lever 5C in only the door opening DO direction but is otherwise similar to the hinge assembly H4.

In particular, the hinge assembly H5 includes a damper system DP5 including a damper housing DH that is secured to the door mounting lever 5C in a fixed position in the space CS between the side walls C1,C2 by a rivet or other inner damper securement fastener F3 that extends through the damper housing DH and through one or preferably both side walls C1,C2. The first and second side walls C1,C2 of the door mounting lever 5C also include respective first and second elongated slots CL1,CL2 (the slot CL1 is identical to the slot CL2 and aligned/registered with the slot CL2). The first and second elongated slots CL1,CL2 are each spaced axially outward from the inner damper fastener F3, and the first and second elongated slots CL1,CL2 each extend linearly along respective axes that lie parallel to the central axis of the damper bore PR. Opposite first and second ends of a rivet or other damper actuating fastener PT are slidably located in the respective first and second elongated slots CL1,CL2 such that the damper actuating fastener PT is adapted to slidably reciprocate and does slidably reciprocate in the slots CL1,CL2 toward and away from the main pivot fastener F1 and inner damper fastener F3 during operation of the hinge assembly H5 as described in more detail below.

The damper P includes a damper body PB that is slidably engaged with and slidably supported by the damper housing DH, and the damper housing DH operatively captures the damper body PB adjacent the lever wall C3 but allows reciprocal sliding movement of the damper body PB along an axis that extends parallel to the lever wall C3. The damper P is shown installed in a first orientation with its rod PD directed inwardly toward and in abutment with the inner damper fastener F3, but the damper P can be reversed and located in a second orientation with the damper body PB abutted with the inner damper fastener F3 and with the damper rod PD projecting outwardly toward the damper actuating fastener PT.

The damper return spring RS biases the damper rod PD to its extended position as shown in FIG. 11A which urges the damper body PB into continuous abutment with the damper actuating fastener PT such that the damper actuating fastener PT is urged outwardly away from the inner damper securement fastener F3 a maximum extent as limited by the length of the elongated slots CL1,CL2. In use, as described below, the damper body PB is selectively movable inwardly toward the inner damper securement fastener F3 so that the rod PD is moved toward and into a retracted position relative to the damper housing PB as shown in FIG. 11C. As noted above, retraction of the rod PD from its extended position is damped by the damping fluid contained in the damper bore PR acting on the piston PP as the piston PP and rod PD retract into the damper body DB.

The hinge assembly H5 includes a slide link 5E that is identical or at least substantially identical to the slide link 4E described above. The slide link 5E includes opposite inner and outer ends 5E1,5E2. The outer end 5E2 is conformed and dimensioned to include or be connected to a damper engagement structure or damper engagement portion DX that directly contacts or directly or indirectly engages the damper actuating fastener PT (and/or that directly contacts or directly or indirectly engages the damper P itself) at an intermediate position of the door mounting arm 5C corresponding to a partially opened position of the oven door D as shown in FIG. 11B. As described above, the damper body PB is biased into abutment or engagement with or is otherwise operatively engaged with the damper actuating fastener PT. As such, after contact between the damper engagement portion DX and the damper actuating fastener PT and/or damper P during movement of the door mounting arm 5C in the door opening direction DO, further pivoting movement of the door mounting lever 5C in the door opening direction DO causes the slide link 5E to move inwardly toward the main pivot fastener F1 and whereby the damper engagement portion DX urges the damper actuating fastener PT and damper body PB inwardly toward the main pivot fastener F1 and toward the inner end CI of the door mounting lever 5C, which results in retraction of the piston PP and piston rod PD and activation of the damper P such that the damper P exerts a damping force DF' between the slide link 5E and the door mounting lever 5C and counteracts the weight of the door D to slow and damp movement of the lever 5C in the door opening direction DO. The damper engagement structure/portion DX is shown herein as being provided as part of and/or connected to the slide link 5E, but the damper engagement structure/portion DX can alternatively or additionally be provided as part of and/or connected to the inner end R1 of the spring rod R (as shown in broken lines at DX' in FIG. 11C) and/or can be provided by any other component that is connected to and/or operatively engaged with either the spring rod R and/or the slide link 5E and operate in the same manner as described above. As noted, the orientation of the damper P can be reversed such that the damper body PB is abutted against or otherwise operatively engaged and restrained by the inner damper securement fastener F3 and such that the piston rod PD or a component connected thereto or engaged therewith is abutted with or otherwise operatively engaged with the damper actuating fastener PT. In such case, the damper P is activated to damp movement of the lever 5C in the door opening direction DO when the damper actuating fastener PT is urged inwardly by the damper engagement structure DX upon movement of the lever 5C in the door opening direction DO such that the damper actuating fastener PT urges the piston rod PD from its extended position toward its retracted position (or the damper engagement structure DX directly or otherwise indirectly contacts the piston rod PD and urges the piston rod PD from its extended position toward its retracted position in the same manner in the case where the installation orientation of the damper P is reversed). The inward movement of the damper actuating fastener PT toward the inner damper securement fastener F3 is limited by the length of the elongated slots CL1,CL2 and the slots CL1,CL2 thus provide a stop that limits pivoting movement of the door mounting lever 5C in the door opening direction beyond the second operative (door opened) position shown in FIG. 11C. As described above, the damper engagement structure/portion DX,DX', whether provided as part of the slide link 5E and/or the spring rod R or another structure connected to either the slide link 5E or spring rod R, can contact the damper actuating fastener PT to engage the damper P indirectly. Alternatively, the damper engagement structure/portion DX, DX' can directly and/or indirectly contact the damper body PB (or the piston rod PD in the case where the damper P is reversed in its installation orientation) to directly or indirectly engage the damper P.

Upon movement of the door mounting lever 5C in the door closing direction DC, the damper engagement structure/portion DX, DX' is moved outwardly away from the damper actuation fastener PT and separates and is disengaged therefrom and disengaged from the damper P such that the damper return spring RS resets the damper P to its extended deactivated position where the piston rod PD is extended relative to the damper body PB. When the piston rod PD is extended relative to the damper body PB, the damper P urges the damper actuation fastener PD outwardly in the elongated slots CL1,CL2 a maximum distance away from the inner damper securement fastener F3 as limited only by the length of the slots CL1,CL2.

As described herein, the damper system DP5 damps relative pivoting movement between the arm A and the door mounting lever 5C for at least part of the relative movement between the arm A and the lever 5C when the arm and lever pivot relative to each other from the first position (door closed position) toward the second position (door opened position). In particular, the damper P is engaged by the damper engagement structure DX,DX' at the intermediate position (FIG. 11B), at the second position (FIG. 11C), and for all operative positions of the lever 5C between the intermediate position and the second position. The damper P is disengaged from the damper engagement structure DX,DX' when the lever 5C and arm are located in the first position (FIG. 11A) relative to each other and for all operative positions of the lever 5C between the first position and the intermediate position.

The development has been described with reference to preferred embodiments. Modifications and alterations will occur to those of ordinary skill in the art to which the invention pertains, and it is intended that the invention be construed as broadly as possible while maintaining their validity in order to encompass all such modifications and alterations.

The invention claimed is:

1. A hinge assembly for an associated appliance door, said hinge assembly comprising:

an arm;

a lever adapted to be connected to the associated appliance door, the lever comprising an inner end pivotally connected to the arm and an outer end spaced from said inner end, said lever and arm adapted to pivot relative to each other about a main pivot axis between a first position that corresponds to a closed position of the associated appliance door and a second position that corresponds to an opened position of the associated appliance door, wherein said lever and arm pivot relative to each other through an intermediate position located between the first and second positions when the lever and arm pivot between the first and second positions;

a slide link located adjacent the lever and comprising a slide link inner end and a slide link outer end spaced from said slide link inner end, said slide link inner end pivotally connected to the arm at a location that is offset from said main pivot axis such that relative pivoting movement between said lever and said arm about said main pivot axis results in movement of the slide link relative to the lever;

a biasing system for urging the arm and lever toward said first position;

a damper system that damps pivoting movement between the arm and the lever for: (i) at least part of the pivoting movement between the arm and the lever when the arm and lever pivot relative to each other from the first position toward the second position; and, (ii) at least part of the pivoting movement between the arm and the lever when the arm and lever pivot relative to each other from the second position toward the first position;

said damper system comprising a damper, said damper including: (i) a first portion that is operably engaged between said slide link and said lever during at least part of the relative movement between the arm and the lever relative to each other from the first position toward the second position; and, (ii) a second portion that is operably engaged between said arm and said lever during at least part of the relative movement between the arm and the lever from the second position toward the first position.

2. The hinge assembly as set forth in claim 1, wherein said first portion of said damper is operably engaged between said slide link and said lever when said lever is located in said intermediate position, when said lever is located in said second position, and for all positions of said lever between said intermediate position and said second position.

3. The hinge assembly as set forth in claim 2, wherein said first portion of said damper is disengaged from said slide link when said lever and arm are located in said first position and for all positions of said lever between said first position and said intermediate position.

4. The hinge assembly as set forth in claim 2, wherein said first portion of said damper is operably engaged directly by said slide link when said lever is located in said intermediate position, when said lever is located in said second position, and for all positions of said lever between said intermediate position and said second position.

5. The hinge assembly as set forth in claim 2, wherein said first portion of said damper is operably engaged indirectly with said slide link when said lever is located in said intermediate position, when said lever is located in said second position, and for all positions of said lever between said intermediate position and said second position.

6. The hinge assembly as set forth in claim 1, wherein said biasing system comprises a spring operatively engaged with the lever and the slide link, said spring exerting a biasing force on the slide link relative to the lever that urges the slide link toward the outer end of the lever and that urges the lever and arm toward the first position.

7. The hinge assembly as set forth in claim 6, wherein said biasing system further comprises a spring rod that comprises an inner end connected to said slide link outer end, said spring rod comprising an outer end including a stop, wherein said spring is coaxially positioned about the spring rod and captured between said stop and a transverse wall of said lever, said spring resiliently biasing said spring rod and slide link outwardly away from the main pivot axis.

8. The hinge assembly as set forth in claim 7, wherein said first portion of said damper is engaged by said spring rod when said lever is located in said intermediate position, when said lever is located in said second position, and for all positions of said lever between said intermediate position and said second position.

9. The hinge assembly as set forth in claim 1, wherein said lever comprises first and second side walls, and wherein said first and second side walls respectively comprise first and second elongated slots that are aligned with each other, said hinge assembly further comprising a damper actuating fastener including opposite first and second ends that are respectively slidably located in said first and second elongated slots such that said damper actuating fastener extends between said first and second side walls of said lever, and wherein said damper actuating fastener is in contact with said first portion of said damper.

10. The hinge assembly as set forth in claim 9, wherein said first portion of said damper is indirectly engaged by said damper actuating fastener when the damper actuating fastener moves inwardly toward said main pivot axis when said lever pivots relative to the arm from the intermediate position toward the second position.

11. The hinge assembly as set forth in claim 10, wherein said first and second elongated slots block inward movement of the damper actuating fastener toward said main pivot axis at said second operative position of said lever such that said damper actuating fastener provides a stop that limits pivoting movement of the lever away from the first operative position beyond the second operative position.

12. The hinge assembly as set forth in claim 11, wherein said damper comprises a piston that reciprocates in a bore and a piston rod connected to said piston and that projects outwardly from said bore, and wherein said first and second elongated slots each extend linearly along respective axes that lie parallel to a central axis of the damper bore.

13. The hinge assembly as set forth in claim 12, wherein said damper system further comprises a damper housing secured to the lever, and said damper comprises a damper body that is slidably supported by said damper housing.

* * * * *